US010378347B2

(12) United States Patent
Massey

(10) Patent No.: US 10,378,347 B2
(45) Date of Patent: Aug. 13, 2019

(54) SIDEWALL CORE DETECTION

(71) Applicant: Schlumberger Technology Corporation, Sugar Land, TX (US)

(72) Inventor: James Massey, Longview, TX (US)

( * ) Notice: Subject to any disclaimer, the term of this patent is extended or adjusted under 35 U.S.C. 154(b) by 588 days.

(21) Appl. No.: 14/961,774

(22) Filed: Dec. 7, 2015

(65) Prior Publication Data

US 2017/0159429 A1 Jun. 8, 2017

(51) Int. Cl.
*E21B 49/06* (2006.01)

(52) U.S. Cl.
CPC ..... *E21B 49/06* (2013.01)

(58) Field of Classification Search
CPC ..... E21B 49/06
See application file for complete search history.

(56) References Cited

U.S. PATENT DOCUMENTS 4,449,593 A * 5/1984 Jageler ..... E21B 49/06 175/58
4,714,119 A * 12/1987 Hebert ..... E21B 49/06 175/20
5,310,013 A * 5/1994 Kishino ..... E21B 49/06 175/244
5,767,399 A 6/1998 Smith et al.
6,833,699 B2 12/2004 Galford et al.
7,195,731 B2 3/2007 Jones
7,958,936 B2 6/2011 McGregor et al.
9,063,247 B2 6/2015 Li et al.
9,103,176 B2 8/2015 Delmar et al.
2008/0066534 A1* 3/2008 Reid ..... E21B 49/06 73/152.11
2009/0114447 A1* 5/2009 Reid, Jr. ..... E21B 49/06 175/58
2010/0282516 A1 11/2010 Buchanan et al.
2011/0174543 A1* 7/2011 Walkingshaw ..... E21B 49/06 175/58
2012/0160018 A1 6/2012 Jones et al.
2013/0068531 A1 3/2013 Joulin et al.
2014/0076634 A1 3/2014 Moon et al.
2014/0131033 A1 5/2014 Galvan-Sanchez et al.
2014/0209385 A1 7/2014 Reid, Jr. et al.
2015/0039235 A1 2/2015 Wiener et al.
2015/0062300 A1 3/2015 Li et al.
2015/0063650 A1 3/2015 Hu et al.
2015/0219613 A1 8/2015 Al-Jabari
2015/0226016 A1 8/2015 Delmar et al.

OTHER PUBLICATIONS

International Search Report and Written Opinion issued in the related PCT application PCT/US2016/065210, dated Feb. 16, 2017 (8 pages).
International Preliminary Report on Patentability issued in the related PCT application PCT/US2016/065210, dated Jun. 21, 2018 (7 pages).

* cited by examiner

*Primary Examiner* — Matthew R Buck
(74) *Attorney, Agent, or Firm* — Eileen Pape

(57) ABSTRACT

A coring tool including a coring bit operable to obtain a core sample of a subterranean formation from a sidewall of a wellbore extending into the subterranean formation. The coring tool also includes a storage tube, an actuator operable to move the core from the coring bit into the storage tube, and a sensor operable to generate information related to presence of the core within the storage tube.

16 Claims, 12 Drawing Sheets

SIDEWALL CORE DETECTION

BACKGROUND OF THE DISCLOSURE

Wellbores may be drilled with a drillstring to, for example, locate and produce hydrocarbons. During a drilling operation, it may be desirable to evaluate and/or measure properties of encountered formations, formation fluids, and/or formation gasses. An example property is the phase-change pressure of a formation fluid, which may be a bubble point pressure, a dew point pressure, and/or an asphaltene onset pressure, depending on the type of fluid. In some cases, the drillstring utilized to form the wellbore is removed, and a wireline tool is deployed into the wellbore to test, evaluate, and/or sample the formation and/or formation gas and/or fluid. In other cases, the drillstring may be provided with devices to perform such testing and/or sampling without removing the drillstring from the wellbore. Some formation evaluations may include extracting a core sample from a sidewall of the wellbore using a hollow coring bit. Testing/analysis of the extracted core may then be performed downhole and/or at the surface to assess the formation from which the core sample was extracted.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces an apparatus that includes a coring tool. The coring tool includes a coring bit operable to obtain a core sample of a subterranean formation from a sidewall of a wellbore extending into the subterranean formation. The coring tool also includes a storage tube, an actuator operable to move the core from the coring bit into the storage tube, and a sensor operable to generate information related to presence of the core within the storage tube.

The present disclosure also introduces a method that includes conveying a coring tool within a wellbore extending into a subterranean formation. The coring tool includes a coring bit, a storage tube, an actuator, and a sensor. The coring tool is operated to obtain, with the coring bit, a sample core of the subterranean formation from a sidewall of the wellbore. The actuator is operated to move the core from the coring bit to the storage tube while generating information with the sensor. Via operation of a processing device, the presence of the core within the storage tube is determined based on the information generated by the sensor.

The present disclosure also introduces a method that includes conveying a coring tool within a wellbore extending into a subterranean formation. The coring tool includes a coring bit, a storage tube, an actuator, a force sensor, and a location sensor. The coring tool is operated to obtain, with the coring bit, a sample core of the subterranean formation from a sidewall of the wellbore. The actuator is operated to move the core from the coring bit to the storage tube while the force sensor generates force information related to a force applied to the core by the actuator, and while the location sensor generates location information related to a location of the core relative to the storage tube. Via operation of a processing device, a force-versus-location profile is generated utilizing the force information and the location information. The presence of the core within the storage tube is determined based on the force-versus-location profile.

These and additional aspects of the present disclosure are set forth in the description that follows, and/or may be learned by a person having ordinary skill in the art by reading the materials herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
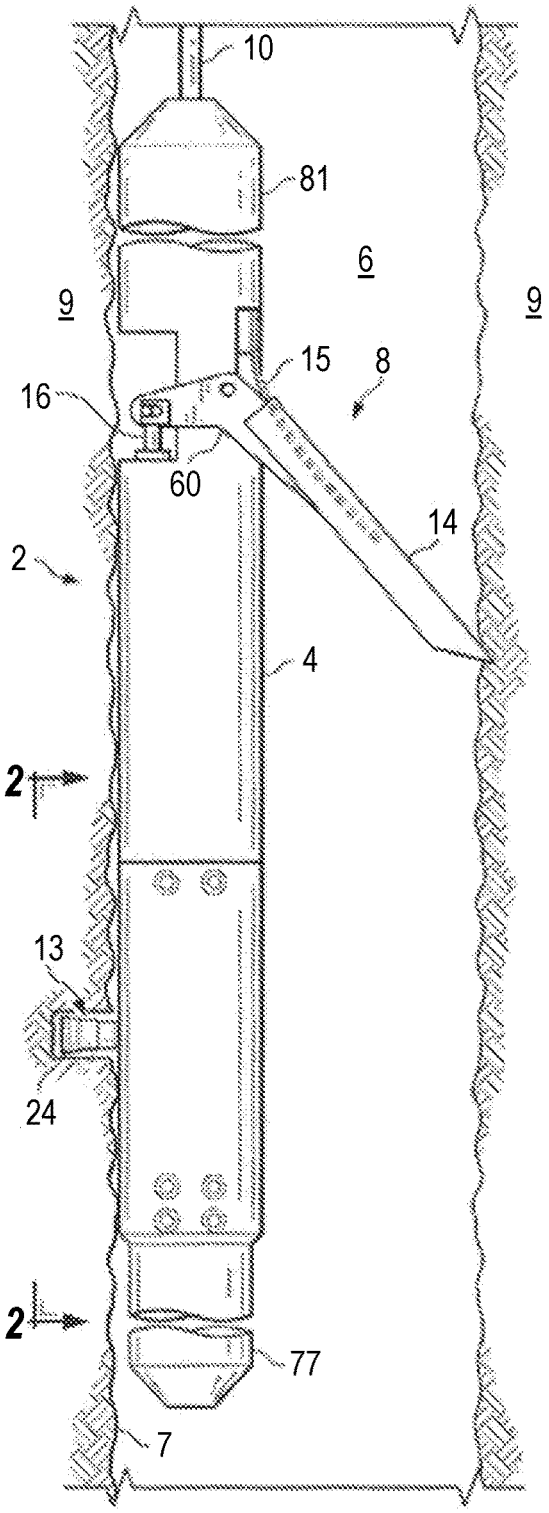
FIG. 1 is a schematic side view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Figure 2:
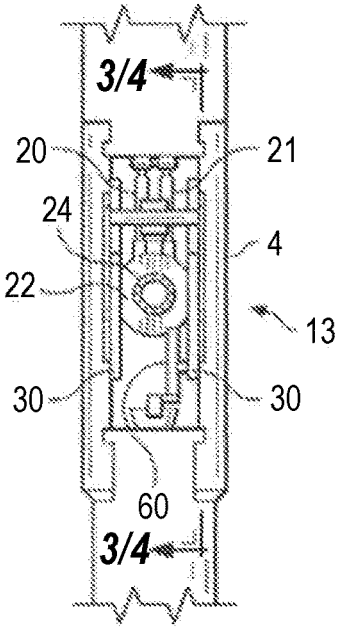
FIG. 2 is a front view of a portion of the apparatus shown in FIG. 1.

FIGS. 1 and 2 are schematic side and front views, respectively, of at least a portion of an example implementation of a coring tool 2 according to one or more aspects of the present disclosure. The coring tool 2 is coupled with a wireline and/or other conveyance means 10 for conveying the coring tool 2 within a wellbore 6, and comprises a core drilling mechanism 13 for cutting cores from a sidewall 7 of the wellbore 6. The conveyance means 10 may also provide means for communication between the coring tool 2 and suitable power sources and control means at a wellsite surface from which the wellbore 6 extends into a subterranean formation 9.

Figure 3:
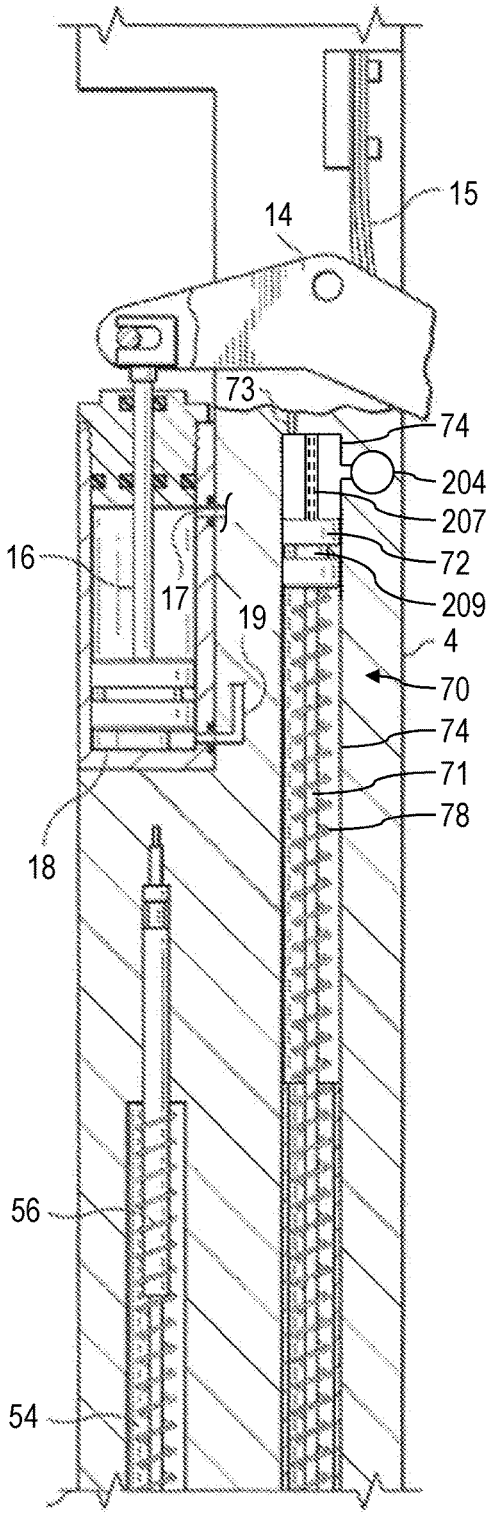
FIGS. 3 and 4 are sectional views of the apparatus shown in FIG. 1.
Figure 4:
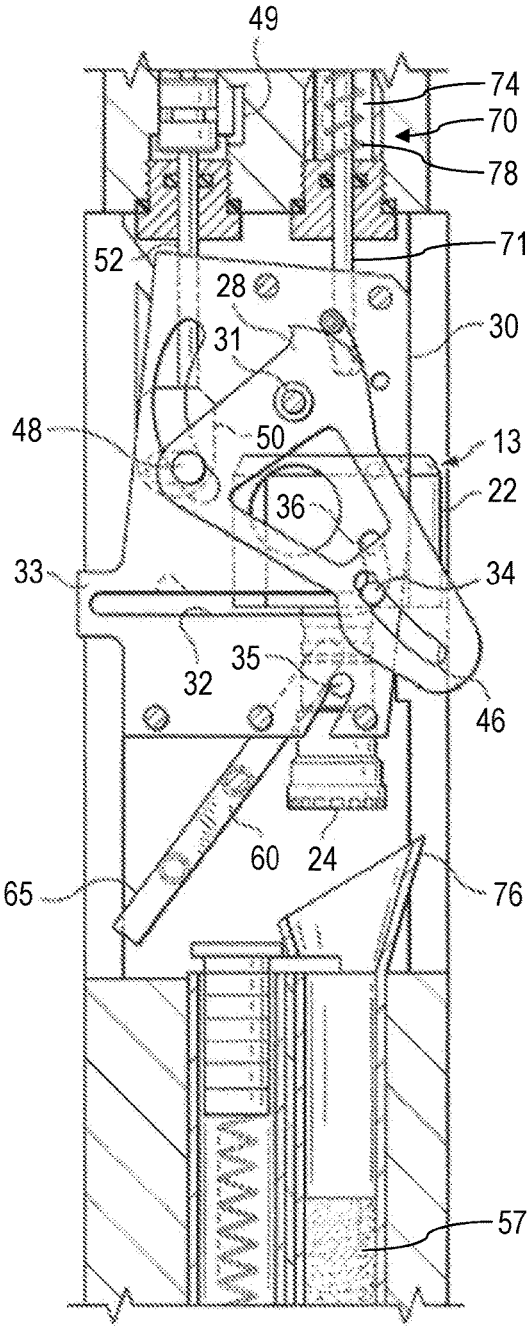

FIGS. 3 and 4 are sectional views of the example implementation of the coring tool 2 shown in FIGS. 1 and 2, taken along section lines 3/4 noted in FIG. 2. As shown in FIGS. 1 and 3, the coring tool 2 may comprise an anchoring mechanism 8 for securing the coring tool 2 at a selected position and depth within the wellbore 6. The anchoring mechanism 8 may comprise an L-shaped anchoring shoe 14 pivotally attached at its vertex to the coring tool 2, such as for movement toward and away from the side of a housing 4 of the coring tool 2 opposite the core drilling mechanism 13. The anchoring shoe 14 lies flush against the housing 4 while the coring tool 2 is conveyed along the wellbore 6. When the coring tool 2 is at the intended position (e.g., depth and/or azimuth within the wellbore 6), the anchoring shoe 14 may be pivoted to an extended position by actuation of a hydraulic ram 16 coupled to the anchoring shoe 14. When the ram 16 retracts into its associated cylinder 18, the anchoring shoe 14 is extended away from the housing 4, thus engaging the sidewall 7 of the wellbore 6 and holding the core drilling mechanism 13 firmly against the sidewall 7 in the intended position. Extension of the ram 16 from the cylinder 18 retracts the anchoring shoe 14 toward the housing 4. Hydraulic lines 17, 19 to opposing ends of the cylinder 18 may be utilized for pressurizing the cylinder 18 to effect the movement of the ram 16. A spring 15 mounted between the housing 4 and the anchoring shoe 14 may automatically retract the anchoring shoe 14 if the hydraulic cylinder 16 fails to operate.

Figure 5:
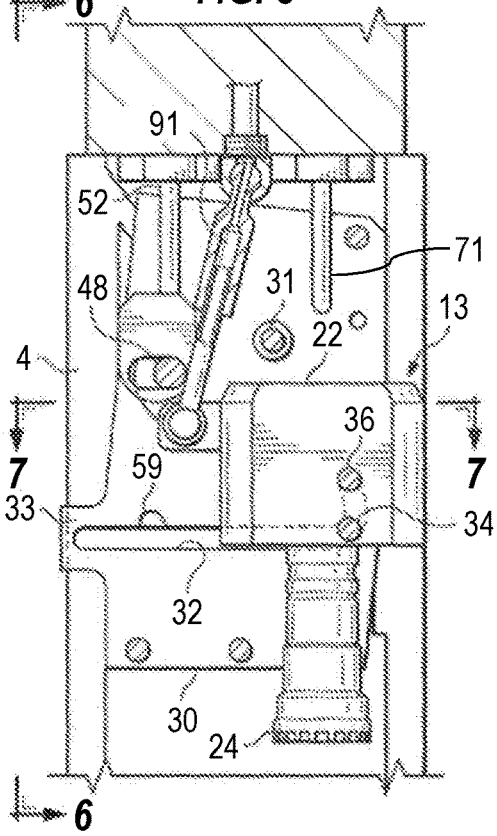
FIG. 5 is another view of the apparatus shown in FIG. 4.
Figure 6:
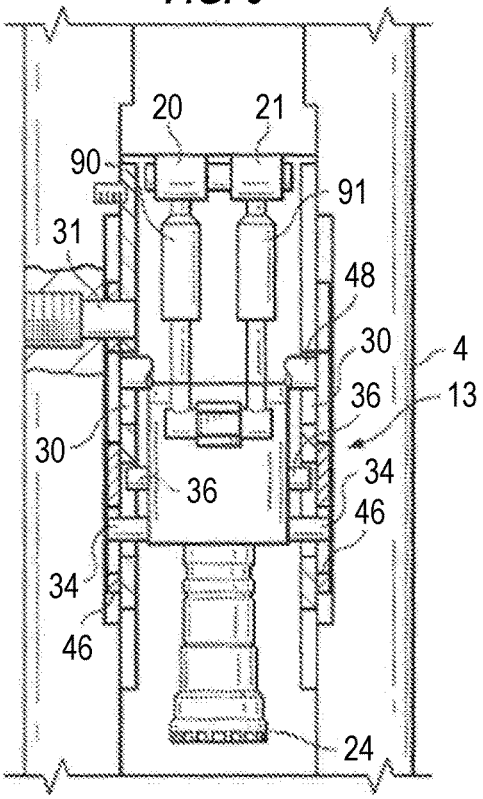
FIG. 6 is a side view of the apparatus shown in FIG. 5.
Figure 7:
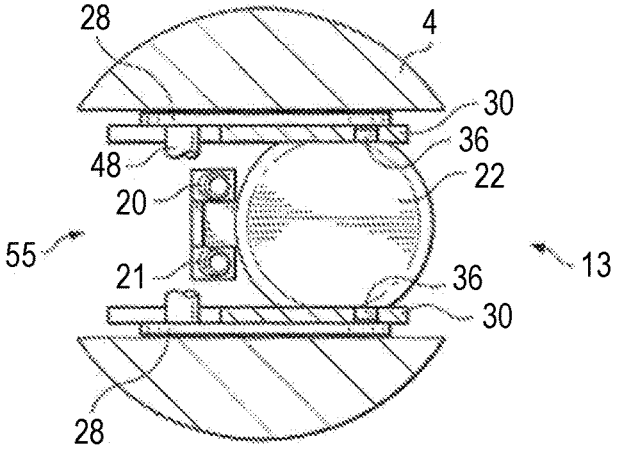
FIG. 7 is a sectional view of the apparatus shown in FIG. 5.

FIG. 5 is a portion of FIG. 4 taken along different section lines and with some components removed for clarity. FIG. 6 is a side view of the apparatus shown in FIG. 5 from the perspective of view lines 6 noted in FIG. 5. FIG. 7 is a sectional view of the apparatus shown in FIG. 5 taken along section lines 7 noted in FIG. 5. The following description refers to FIGS. 2 and 4-7, collectively.

The core drilling mechanism 13 comprises a hydraulic coring motor 22 that is connected by lines 20, 21 to a hydraulic power supply (not shown). The coring motor 22 rotates a coring bit 24. The coring bit 24 may be capable of cutting a core 57 having a diameter of at least about 3.8 centimeters (cm) in diameter and a length of at least about 6.3 cm. The core length may also be at least about 7.6 cm, or at least about 8.9 cm, perhaps still with a diameter of at least about 3.8 cm. To permit the coring motor 22 to fit entirely within the housing 4 in a stowed (vertical) position, the coring motor 22 may have a transverse dimension smaller than the diameter of the housing 4.

Two pins 34, 36 extend from each side of the coring motor 22 on a line perpendicular to a central axis of the coring motor 22. The coring motor 22 is supported by the pins 34, 36 between a pair of support plates 30 that are fixedly mounted to the housing 4. Each fixed support plate 30 comprises a J-shaped guide slot 32 (also referred to herein as J-shaped slot 32 and J-slot 32) in which the pins 34, 36 are engaged. As shown in FIG. 4, the J-shaped slot 32 has its longer leg disposed in a perpendicular direction relative to the central axis of the coring tool 2, with its shorter leg extending almost perpendicular to the longer leg. However, the shorter leg may extend from the longer leg at an angle ranging between about 70 degrees and about 110 degrees relative to the direction in which the longer leg extends. Similarly, the spacing and positioning of the pins 34, 36 and the dimensions and shape of the J-slot 32 may vary within the scope of the present disclosure. Such spacing, positioning, dimensions, and shape may be such that when the pin 36 is at the end of the shorter leg, the coring bit 24 points in a direction generally parallel with the central axis of the coring tool 2, as shown in FIGS. 4-6.

As also shown in FIGS. 4 and 5, the longer leg of the J-slot 32 may extend almost to the outer perimeter of the housing 4, such as may increase mechanical advantage during repositioning of the coring motor 22. For example, the fixed plate 30 may include an extension 33 projecting radially away from the main or remaining portion of the fixed plate 30, perhaps to or even slightly beyond the housing 4, such that the J-slot 32 may extend further towards the side of the housing 4. However, the extension 33 of the fixed plate 30 may not radially extend up to the side of the housing 4, but may instead be completely enveloped by the housing 4. Moreover, variations from the illustrated implementation (e.g., an L-shaped slot, differently sized extension 33, no extension 33, etc.) also fall within the scope of the present disclosure.

Figure 8:
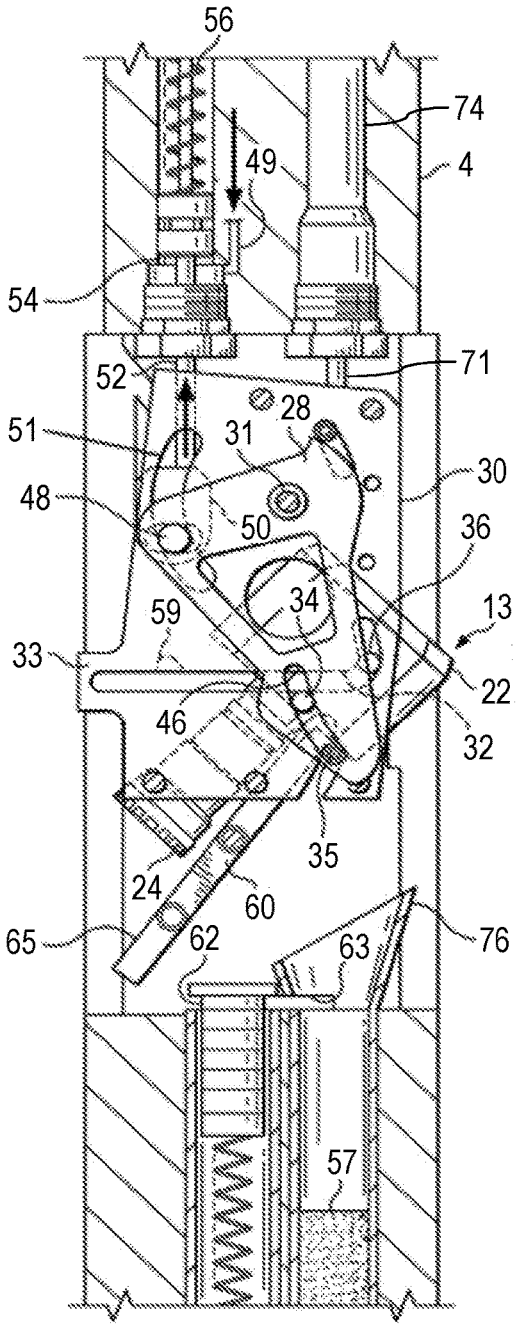
FIGS. 8-11 are additional views of the apparatus shown in FIG. 4 in different stages of operation.
Figure 9:
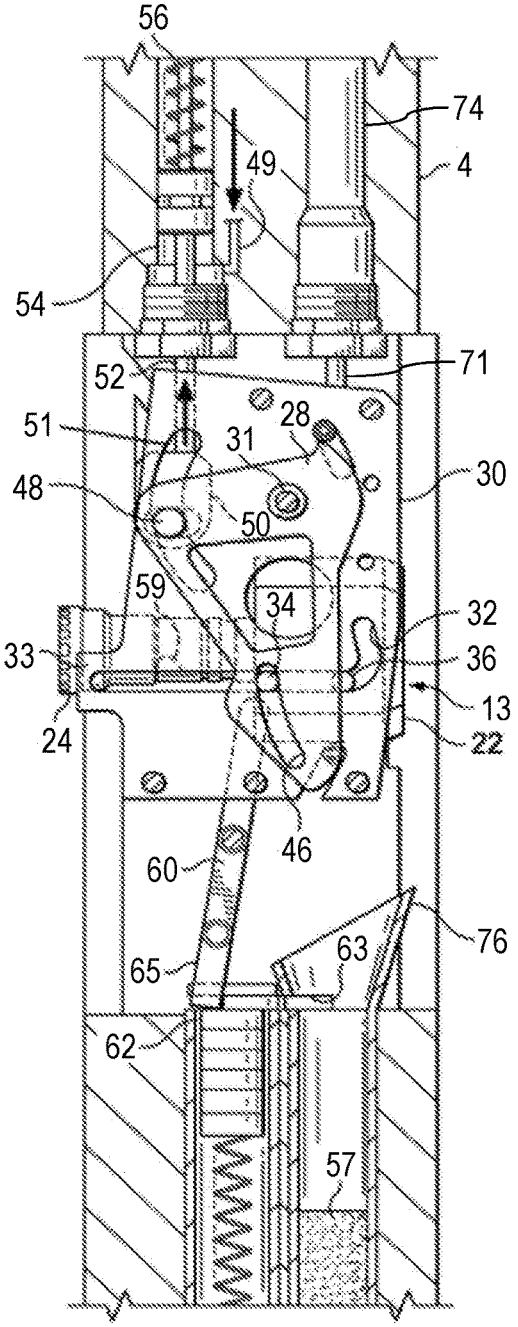

FIGS. 8 and 9 are additional views of FIG. 4 depicting movement of the coring motor 22 towards a coring orientation. As shown in FIGS. 4, 8, and 9, the pins 34, 36 are driven along the J-shaped slot 32 from its shorter leg to the end of its longer leg, such that the coring motor 22 is rotated through 90 degrees and pushed forward toward the sidewall 7 of the wellbore 6. The pins 34, 36 are driven in this manner by a drive mechanism that comprises a pair of drive plates 28 each disposed between one of the fixed plates 30 and the housing 4. Each drive plate 28 is pivoted about a pin 31 near one of its vertices. A slot 46 near a second vertex of each drive plate 28 engages each pin 34. The pin 34 ("leading pin") is longer than the pin 36 ("follower pin") so that it may extend through both the J-slot 32 of the fixed plate 30 and the slot 46 on the drive plate 28. A member 48 extends through arcuate slots 51 of the fixed plates 30 and between the two drive plates 28 near the third vertex of each, and is coupled by a yoke 50 at its midpoint to a ram 52 in a hydraulic cylinder 54, which may be selectively pressurized. The hydraulic cylinder 54 extends axially in the housing 4, and may have a pressure inlet 49 for connection to a hydraulic line.

Referring to FIGS. 4, 5, 8, and 9, as the ram 52 retracts into the cylinder 54, the drive plates 28 are pivoted about the pivot pins and act as cams, thereby pushing the leading pin 34 along the J-shaped slot 32 to rotate the coring motor 22 to a radial position. Sliding fittings 90, 91 on the inlets of the lines 20, 21 to the coring motor 22 accommodate this motion. After the core drilling mechanism 13 has been rotated (e.g., by about 90 degrees) to the radial position by retraction of the ram 52 into the hydraulic cylinder 54, further upward movement of the ram 52 causes forward movement of the core drilling mechanism 13 radially outward from an opening 55 in the housing 4 and into engagement with the sidewall 7 of the wellbore 6. At or prior to reaching the radial position, the shaft of the coring motor 22 is rotated (by a system described below), causing the coring bit 24 to drill a core 57 as the pins 34, 36 move toward the longer leg of the J-slot 32.

Figure 10:
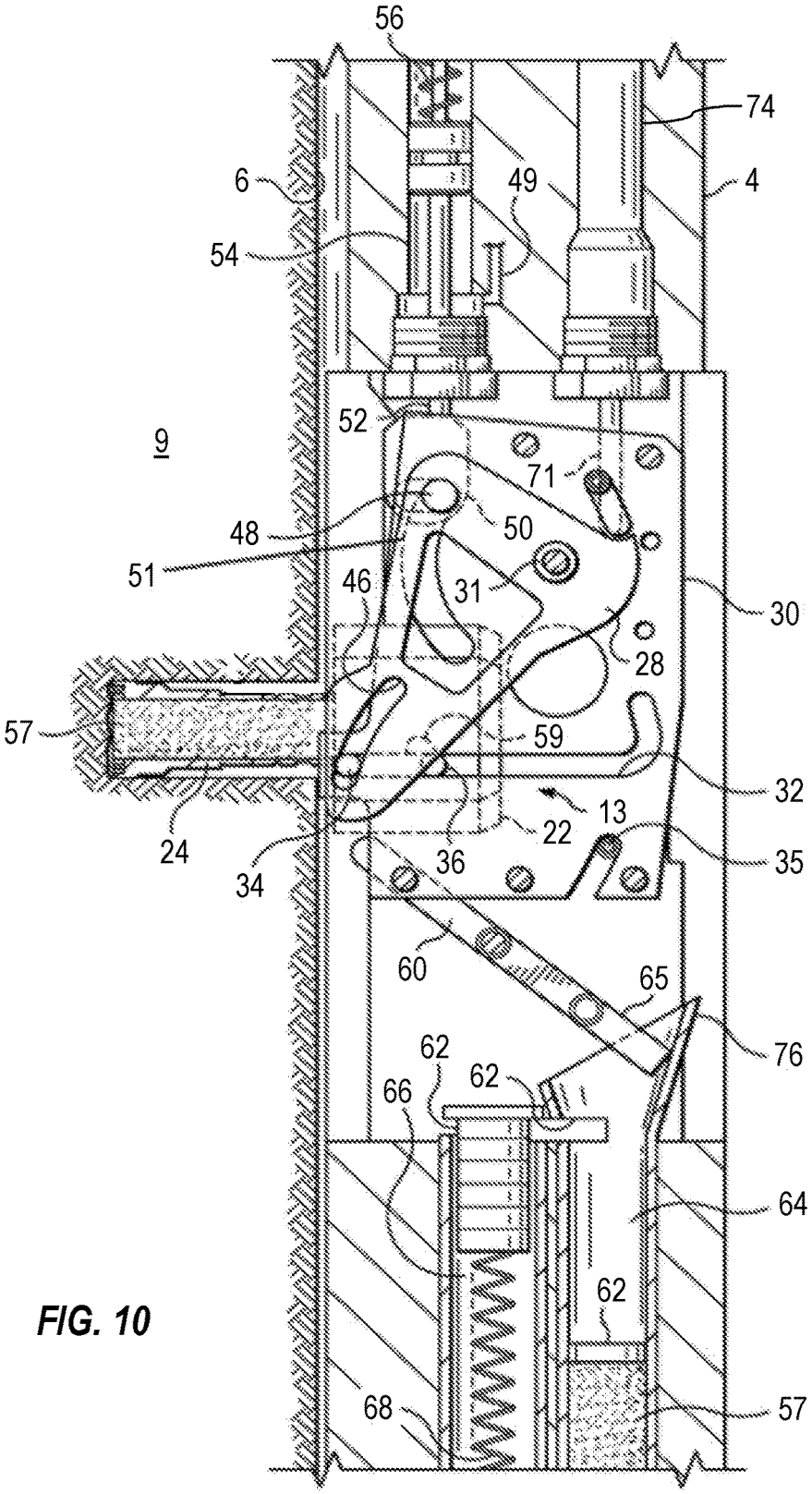

FIG. 10 is another view of FIG. 9 after the coring bit 24 has penetrated the formation 9. As shown in FIG. 10, the follower pins 36 move into position adjacent a pair of notches 59 extending upward from the longer leg of the J-slot 32 when the leading pins 34 reach the ends of the J-slots 32. Then, continued upward movement of the hydraulic ram 52 generates a lifting force, which moves member 48 upward within the arcuate slots 51 of each fixed plate 30, such that the follower pins 36 are raised up into the notches 59 to tilt the core drilling mechanism 13. The coring bit 24 thereby severs the core 57 by levering the core at its front edge. To prevent the longer, leading pin 34 from jamming in the notch 59 and obstructing forward movement of the coring motor 22, the notch 59 may not extend through the full thickness of the plate 30, but instead perhaps just far enough to accommodate the follower pin 36. However, other means for severing the core 57 from the formation 9 are also within the scope of the present disclosure. For example, the fixed plates 30 may simply be fixed kinematically while the pins 34 and 36 travel along a substantial portion of the J-slots 32, but may rotate about additional pivots 35 after the pins 34 and 36 near or reach the end of the J-slots 32.

After the core 57 has been severed, the core drilling mechanism 13 is retracted and returned to its axial position by extension of the ram 52 as the cylinder 54 is pressurized. A return spring 56 inside the cylinder 54 may aid in ensuring that the core drilling mechanism 13 is retracted even if the hydraulic system fails.

Figure 11:
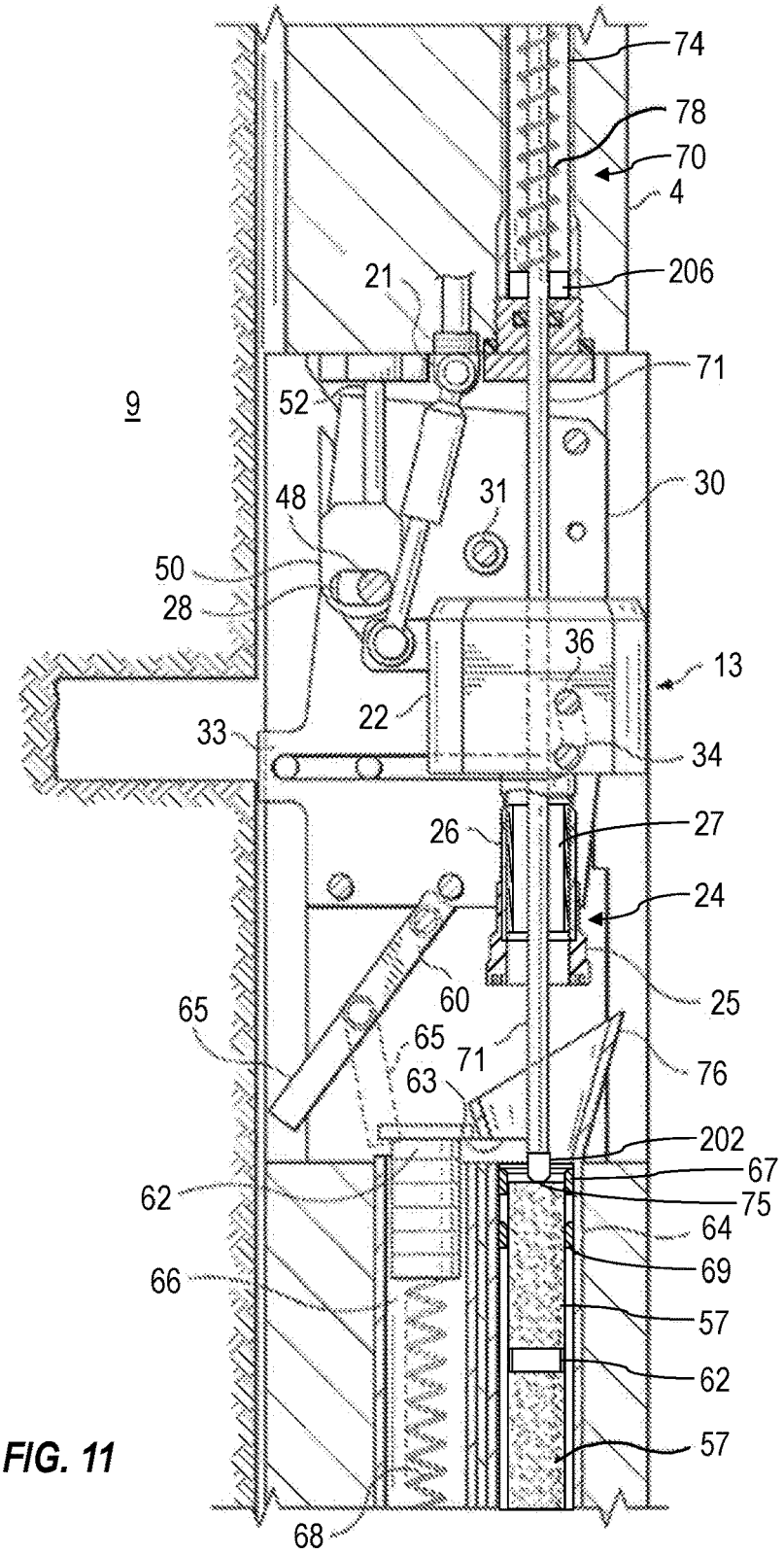

The coring tool 2 also comprises an actuator 70 for moving the captured core 57 from the coring bit 24 into a storage tube 64 axially disposed within a lower portion 77 of the coring tool 2 (shown in FIG. 1). Portions of an example implementation of the actuator 70 are shown in FIGS. 3-5 and 8-11. The actuator 70 comprises a core pusher rod 71 attached to a piston 72 within a hydraulic cylinder 74. A hydraulic line 73 provides hydraulic communication between the cylinder 74 and a hydraulic fluid source (not shown) of the coring tool 2 to move the piston 72 within the cylinder 74. Hydraulic fluid power may also be utilized to subsequently retract the piston 72 and core pusher rod 71, although one or more springs 78 within the cylinder 74 may also or instead be utilized for such retraction. After the core drilling mechanism 13 reaches the axial position, as shown in FIG. 11, the core pusher rod 71 is extended through the core drilling mechanism 13 by movement of the piston 72, thereby pushing the core 57 out of the core-retaining sleeve 26 of the coring bit 24 and into a funnel-like guide 76 that conducts the core 57 into a cylindrical storage tube 64. The anchoring shoe 14 may then be retracted to permit the coring tool 2 to again be conveyed within the wellbore 6, such as to another coring operation position within the wellbore 6.

FIG. 11 also depicts an example implementation of the coring bit 24. For example, the coring bit 24 may comprise a diamond and/or other material bit 25 coupled to an end of a hollow shaft 26 rotated by the coring motor 22. The coring bit 24 may also comprise a core retainer 27 that retains the severed core 57 within the coring bit 24 until the core pusher rod 71 moves the core 57 from the coring bit into the storage tube 64.

Referring to FIGS. 2, 4, and 8-11, while the coring motor 22 moves forward to drill the core, its leading edge pushes a kicker rod 60 that is pivoted to the housing 4. A kicker foot 65 extends transversely from the rod 60 to kick a core marker disk 62 through a guide slot 63 in the guide 76 and into the storage tube 64 to separate and mark successively drilled cores 57. The core marker disks 62, which can be manufactured of various materials that will not deteriorate under typical wellbore conditions or damage the cores 57, are stacked and biased upward (e.g., by spring 68) in a core marker barrel 66 adjacent the storage tube 64. A spring (not shown) mounted between the housing 4 and the kicker rod 60 may bias the kicker rod 60 toward its original position. The foot 65 may be hinged to bend as it passes over the core markers 62 as the kicker rod returns, after which it is straightened by, for example, a torsional spring (not shown). However, other means for individually moving the core markers 62 into the storage tube 64 are also within the scope of the present disclosure. For example, instead of the kicker rod 60 and foot 65, a hydraulic cylinder may be selectively actuated to position the core markers 62 in the storage tube 64.

A coring motor hydraulic circuit (not shown) may drive the coring motor 22 with, for example, a pump powered by an electric motor. The coring motor hydraulic circuit may be housed in an upper portion 81 of the housing 4, as shown in FIG. 1. A positioning drive system hydraulic circuit (not shown), which may also be housed in the upper portion 81 of the housing 4, may drive a downhole pump with a motor, and may also drive the anchoring shoe ram 16, the core pusher piston 72, and the drive plate ram 52. A feedback flow controller may control weight-on-bit (WOB) applied to the coring bit 24 by, for example, using backpressure in the coring motor circuit to control a needle valve in the line to the drive plate ram 52. The backpressure may increase as resisting torque from the formation 9 increases, thus slowing down the drive plate ram 52 to slow the forward movement of the coring bit 24. However, other means for controlling WOB are also within the scope of the present disclosure. For example, instead of the above-described feedback flow controller, the coring tool 2 may include a pressure gauge and a downhole microcontroller to modulate the WOB with an electric solenoid.

In operation, the coring tool 2 may be lowered into the wellbore 6 on the conveyance means 10 while the anchoring shoe 14 is held flush against the housing 4. When the coring tool 2 reaches the intended depth, a signal from surface equipment causes flow to the anchoring shoe cylinder 18 to extend the anchoring shoe 14 outward and anchor the coring tool 2 in the intended position against the formation 9. Subsequent surface equipment signals may cause flow to the drive plate cylinder 54 to rotate the coring motor 22 and move it toward the formation 9. As this occurs, the coring motor 22 may be driven (e.g., by its corresponding pump). The above-described feedback flow controller or pressure gauge/microcontroller combination may control forward speed and/or pressure of the coring motor 22 as it cuts a core 57. After the core 57 is severed from the formation 9, flow to cylinder 54 retracts the coring motor 22 to its axial position, and flow to cylinder 74 extends the core pusher rod 71 to move the core 57 into the storage tube 64.

Some attempts to retrieve a core 57 from the formation 9 may fail for a variety of reasons. However, such failure is often not detected until the coring tool 2 is removed from the wellbore 6 and inspected. The present disclosure introduces various sensors and other aspects that may be utilized, whether individually or in combination, to detect the presence of the core 57 within the coring tool 2 while the coring tool 2 remains in the wellbore 6.

For example, as described above, the actuator 71 is operable to move the core 57 from the coring bit 24 into the storage tube 64 by applying a force on the core 57 throughout a distance extending between a first core position and a second core position. When the core 57 is in the first core position, the core 57 is retained within the core retainer 27 of the coring bit 24. When the core 57 is in the second core position, the core 57 is contained within the storage tube 64, because the tip 75 of the core pusher rod 71 has travelled through the guide 76 and into the storage tube 64, as depicted in FIG. 11.

The coring tool 2 may also comprise a force sensor 202 operable to generate information related to the force applied to the core 57 by the core pusher rod 71. The force sensor 202 may be or comprise a load cell, strain gauge, and/or other means for measuring the amount of force applied to the core 57 by the core pusher rod 71 as the core pusher rod moves the core 57 between the first and second core positions. The coring tool 2 may also comprise a force sensor 204 (shown in FIG. 3) operable to generate information related to the force applied to the core 57 by the core pusher rod 71 based on the pressure of hydraulic fluid within the cylinder 74. The coring tool 2 may comprise one or both of the force sensors 202 and 204.

The coring tool 2 may also comprise a position sensor 206 operable to generate information related to the position of the core pusher rod 71 and, thus, the location of the core 57 between the first and second core positions. The position sensor 206 may be or comprise a linear or string potentiometer and/or other means for determining the amount of extension of the core pusher rod 71, the location of the tip 75 of the core pusher rod 71, the location of the piston 72 within the cylinder 74, and/or other measurement by which the location of the core 57 can be measured substantially continuously throughout the travel between the first and second core positions. In some implementations, the position sensor 206 may comprise a potentiometer having a portion 207 (partially shown by phantom lines in FIG. 3) extending along or within the core pusher rod 71 and another portion 209 (e.g., a magnet) carried with the piston 72.

The coring tool 2, and/or surface equipment in communication with the coring tool 2, comprises a processor and a memory storing instructions executed by the processor. An example implementation of the processor and memory are described below with respect to FIG. 24. When executed by the processor, the instructions may cause the processor to determine the presence of the core 57 within the storage tube 64 based on the force information generated by at least one of the force sensors 202 and 204 and the location information generated by the position sensor 206.

Figure 12:
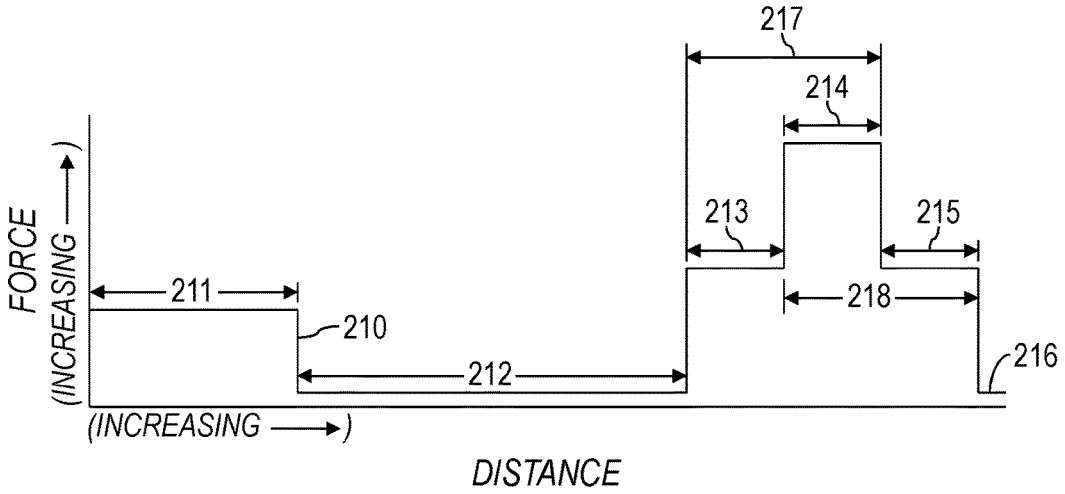
FIGS. 12-14 are graphs depicting aspects of the present disclosure.

For example, the processor may generate a force-versus-location profile 210 as depicted in FIG. 12. The force-versus-location profile 210 may include an initial portion 211 during which the core 57 is being pushed by the core pusher rod 71 out of the core retainer 27 of the coring bit 24, and the force measured utilizing the force sensor 202 and/or the force sensor 204 may be the force sufficient to overcome the friction between the core 57 and the core retainer 27. During a subsequent portion 212 of the profile 210, after the core 57 fully departs core retainer 27, the measured force may be minimal (perhaps negligible) as the core pusher rod 71 moves the core 57 into contact with an upper core retainer 67 within the storage tube 64, such as may be located at or near the open end of the storage tube 64. During a subsequent portion 213 of the profile 210, the measured force may be the force sufficient to overcome the friction between the core 57 and the upper core retainer 67, until the core pusher rod 71 moves the core 57 into contact with a lower core retainer 69 within the storage tube 64, such as may be located a short distance (e.g., about one-third to one-half the average core length) away from the upper core retainer 67. During a subsequent portion 214 of the profile 210, the measured force may be the force sufficient to overcome the friction between the core 57 and both the upper core retainer 67 and the lower core retainer 69. During a subsequent portion 215 of the profile 210, after the core 57 fully departs the upper core retainer 67, the measured force may be the force sufficient to overcome the friction between the core 57 and just the lower core retainer 69. During a final portion 216 of the profile 210, after the core 57 fully departs the lower core retainer 69, the measured force may again be minimal (perhaps negligible).

Figure 13:
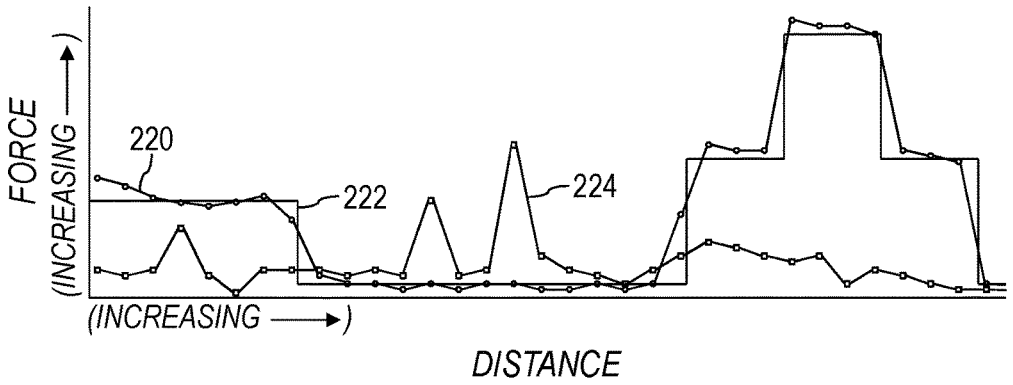

The force-versus-location profile 210 may be indicative of the presence of the core 57 within the storage tube 64. That is, the increased force levels measured when the core 57 is moving through the upper and lower core retainers 67 and 69 indicates that the core 57 was indeed obtained from the formation 9 and is being moved into the storage tube 64 by the core pusher rod 71. However, more sophisticated use of the profile 210 is also within the scope of the present disclosure. For example, the instructions executed by the processor may also cause the processor to determine the presence of the core 57 within the storage tube 64 by comparison of the force-versus-location profile 210 to a predetermined force-versus-location profile also stored in the memory. FIG. 13 is a graph depicting an example force-versus-location profile 220 obtained as described above for a successful core retrieval operation, relative to an example predetermined force-versus-location profile 222. FIG. 13 also depicts an example force-versus-location profile 224 obtained as described above for an unsuccessful core retrieval operation, in which no core sample was successfully moved into the storage tube 64, such that the profile 224 remains substantially negligible throughout movement of the core pusher rod 71, except for occasional data spikes that may be considered to be caused by various errors. The comparison between the measured profiles 220, 224 and the predetermined profile 222 may be by various methods. For example, a least-squares method of comparing curves fitted to the force/location data/profiles may indicate that a core was successfully moved into the storage tube 64 if the $R^2$ difference between the measured and predetermined data/profiles exceeds 95%, or some other predetermined threshold. However, other comparison methods are also within the scope of the present disclosure.

When executed, the instructions stored in the memory may also cause the processor to generate information indicative of the length of a core 57 being moved into the storage tube 64 based on the force/location information generated by the sensors 202, 204, 206. For example, returning to FIG. 12, the profile portion 213 corresponds to the core moving through the upper core retainer 67 within the storage tube 64, and the profile portion 214 corresponds to the core moving through both the upper core retainer 67 and the lower core retainer 69, while the profile portion 215 corresponds to the core having departed the upper core retainer 67 but still moving through the lower core retainer 69. By knowing the axial length of the upper core retainer 67, the axial length of the lower core retainer 69, and the axial separation between the upper and lower core retainers 67 and 69, the length of the core may be estimated as the distance 217 between the start of the profile portion 213 (when the core enters the upper core retainer 67) and the end of the profile portion 214 (when the core departs the upper core retainer 67 but is still within the lower core retainer 69). Similarly, length of the core may be estimated as the distance 218 between the start of the profile portion 214 (when the core is already within the upper core retainer 67 and then also enters the lower core retainer 69) and the end of the profile portion 215 (when the core departs the lower core retainer 69). An average of these lengths 217 and 218 may also be utilized. The core length can be a valuable piece of information, because a core may occasionally break off from the formation 9 at a length that is shorter than intended for that coring operation, and some core analyses (whether performed after the cores are retrieved from the coring tool 2 at the wellsite surface or in a laboratory setting) may have minimum core lengths for the analysis results to be considered accurate.

Figure 14:
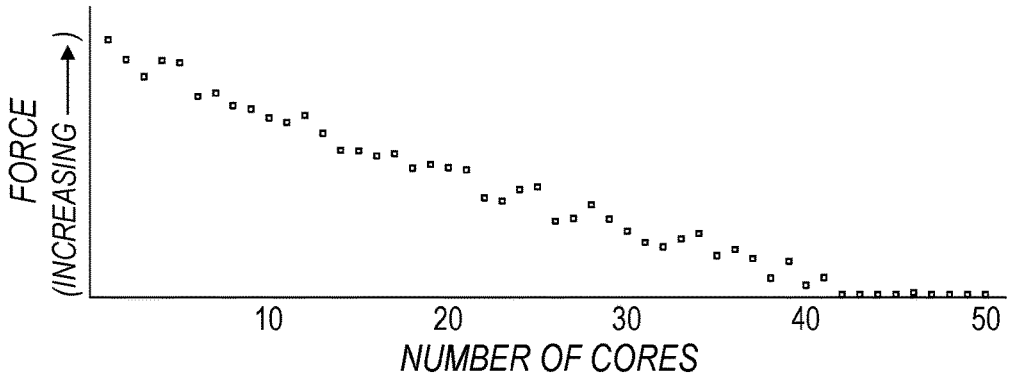

When executed, the instructions stored in the memory may also cause the processor to generate information indicative of the remaining functional life of the core retainer 27 of the coring bit 24 and/or of one or both of the upper and lower core retainers 67 and 69. For example, the average force measured while each core is moving through one of the retainers 27, 67, 69 may be plotted for each core 57. To at least some extent, the retainers 27, 67, 69 each rely on spring force and friction to retain each core 57. As shown in FIG. 14, the average force measured while each core is moving through one of the retainers 27, 67, 69 will gradually decrease as more cores are moved from the coring bit 24 and into the storage tube 64, until the spring force and friction are no longer sufficient to effective retain another core 57. In the example implementation depicted in FIG. 14, the example core retainer would not be highly effective after about 35 cores, at which time the decision may be made to retrieve the coring tool 2 from the wellbore 6 because further coring operations would likely not be successful. For example, if the example data depicted in FIG. 14 was for the core retainer 27 within the coring bit 24, the core retainer 27 may not be able to retain the next core in the coring bit 24. Consequently, that core could fall from the coring bit 24 and become lodged within the coring tool 2 in a manner preventing proper operation of the coring tool 2. For example, the core drilling mechanism 13 may not be able to return into the housing 4, and perhaps causing the coring tool 2 to become stuck within the wellbore 6.

Figure 15:
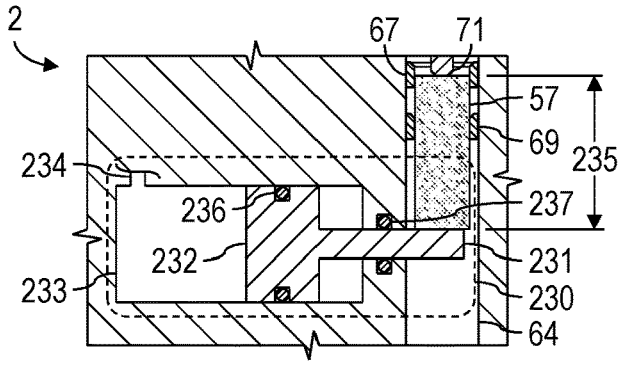
FIGS. 15-21 are schematic sectional views of various implementations of core detection apparatus according to aspects of the present disclosure.

FIG. 15 is a schematic sectional view of a portion of another example implementation of the coring tool 2 shown in FIG. 11 according to one or more aspects of the present disclosure. The coring tool 2 may also comprise a core blocker 230 selectively movable into the storage tube 64 to temporarily prevent a core 57 from moving past the second core position. For example, when a core is in the second core position, it may be fully received within the storage tube 64 and retained by both core retainers 67 and 69 within the storage tube 64, as depicted in FIG. 15. The core blocker 230 may comprise a blocking member 231 attached to or otherwise carried with or movable in response to a piston 232, wherein the piston 232 is slidably disposed within an actuator cylinder 233 disposed within the coring tool 2. Pressure within the cylinder 233 may be controlled via a hydraulic inlet 234 fluidly connecting the cylinder 233 to a hydraulic source (not shown) of the coring tool 2, such as to move the piston 232 within the cylinder 233 and thereby move the blocking member 231 into the storage tube 64, such that the blocking member 231 prevents movement of the core 57 further into the storage tube 64 beyond the second core position.

The core blocker 230 may be utilized with one or both of the force sensors 202 and 204 described above. For example, the core blocker 230 may be selectively actuated to position the blocking member 231 as depicted in FIG. 15 so as to increase resistance against movement of the core 57 deeper into the storage tube 64, thus increasing the force measured by the sensor 202 and/or the pressure measured by the sensor 204, which may permit a higher force to be measured by the sensor 202 and/or 204 and, thus, provide greater accuracy when detecting the presence of the core 57 within the storage tube 64. The core blocker 230 may also be utilized with the position sensor 206 to provide a clear indication of the length 235 of the core 57, based on knowledge of the longitudinal position of the blocking member 231 within the storage tube 64 and the amount of extension of the core pusher rod 71. After utilizing the core blocker 230 for detecting the presence of the core 57 within the storage tube 64 and/or measurement of the length 235 of the core 57, the piston 232 is retracted, thereby retracting the blocking member 231 sufficiently from the storage tube 64 so as to permit the core 57 to be moved further deeper into the storage tube 64.

Various sealing members may also be associated with the core blocker 230. For example, as depicted in the example implementation shown in FIG. 15, a sealing member 236 may fluidly isolate the cylinder 233 on opposing sides of the piston 232 while permitting axial movement of the piston 232 within the cylinder 233, and another sealing member 237 may fluidly isolate the cylinder 233 from the storage tube 64 while permitting axial movement of the blocking member 231 into and from the storage tube 64. The sealing members 236 and 237 may be or comprise O-rings, face seals, gaskets, and/or other fluid isolation/sealing means.

The core blocker 230 and/or aspects thereof may also be utilized in conjunction with implementations of the coring tool 2 other than the example implementation depicted in FIG. 15. Such implementations may include one or more aspects depicted in and/or by one or more of FIGS. 1-14, one or more of the figures described below, and/or other aspects described herein or otherwise within the scope of the present disclosure.

Figure 16:
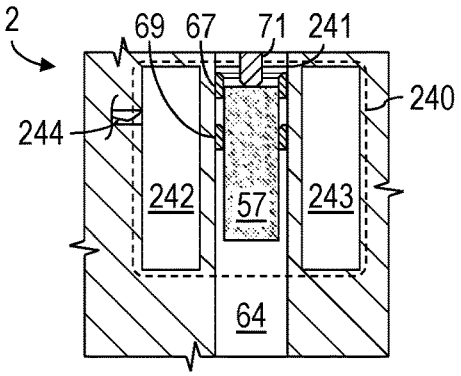

FIG. 16 is a schematic sectional view of a portion of another example implementation of the coring tool 2 shown in FIG. 11 according to one or more aspects of the present disclosure. The coring tool 2 may also comprise a sensor 240 disposed substantially adjacent an outer perimeter of the storage tube 64 and proximate the end 241 of the storage tube 64 through which the core pusher rod 71 of the actuator 70 moves the core 57. That is, the end 241 of the storage tube 64 that is proximate the upper and lower core retainers 67 and 69. The sensor 240 is a non-contact sensor operable to generate information related to the presence of the core 57 within the storage tube 64. As the core 57 passes by the sensor 240, the information generated by the sensor 240 changes accordingly. The sensor 240 has no moving parts, and may thus be substantially resistant to malfunction due to the presence of sand, fluid, and/or other debris introduced into the storage tube 64 and other parts of the coring tool 2 during coring and storage operations.

The sensor 240 may be a sonic or ultrasonic sensor. For example, a first portion 242 of the sensor 240 may be or comprise a sonic or ultrasonic signal emitter, and a second portion 243 of the sensor 240 may be or comprise a sonic or ultrasonic signal detector, such that a sonic or ultrasonic signal may be emitted by the first portion 242 and measured by the second portion 243 after passing through the core 57. The change in the sonic or ultrasonic signal measured by the sensor 240 may be utilized to detect the presence of the core 57 between the first and second portions 242 and 243 of the sensor 240.

Wires or other electrical conductors 244 leading away from the sensor 240 may provide electrical connection with a processing device (not shown in FIG. 16) located within the coring tool 2 that is operable to generate information related to the presence of the core 57 within the storage tube 64 based on information generated by the sensor 240. The processing device of the coring tool 2 may determine the presence of the core 57 within the storage tube 64, or the related information may be transmitted to surface equipment that may be operable for such determination. The information generated by the sensor 240 may also be utilized in combination with information generated by other sensors of the coring tool 2 for detecting the presence of the core 57 within the storage tube 64, measuring a length of the core 57, and/or determining other information about the core 57 in real-time. For example, the information generated by the sensor 240, when implemented as a sonic or ultrasonic sensor, may be combined with time information and/or the location information generated by the sensor 206 to generate a two-dimensional (2D) graph depicting the passage of whatever is moved by the actuator 70 through the sensor 240. Such information may also be utilized with density algorithms to aid in differentiating solid cores 57 from other materials, such as non-solid core samples, debris, and the like.

The sensor 240 may also or instead be a resistivity sensor. For example, the first and second portions 242 and 243 of the sensor 240 may be or comprise electrodes that emit and receive an electrical current, voltage, and/or other signal, so as to measure resistivity of the electrical path between the electrodes, including through the core 57 when the core 57 is located between the electrodes. When the core 57 passes between the electrodes, the core 57 occupies the majority of the region in the storage tube 64 between the electrodes, such that the resistivity measured between the electrodes will change (e.g., relative to when the region between the electrodes is not occupied by the core 57 but is instead occupied by drilling fluid ("mud"), wellbore fluid, etc.). This change in resistance may then be compared to predetermined data (e.g., from previous testing) to determine the presence of the core 57 between the electrodes. Such comparison may also be utilized to determine whether the core 57 is a solid core that has displaced most of the fluid between the electrodes, or that the core 57 is instead an amalgamation of crushed rock, dirt, or other debris suspended in fluid having a much lower resistivity than a solid core.

The sensor 240 may also or instead be a gamma ray sensor. For example, the first portion 242 of the sensor 240 may be or comprise a gamma ray source, and the second portion 243 of the sensor 240 may be or comprise a gamma ray detector, such that the storage tube 64 interposes the source and the detector. As the core 57 passes between the source and detector, the density of the core 57 affects the intensity measured by the sensor 240. The sensor 240 may also be utilized to determine of the density of the core 57, or the lack thereof, if a core was not successfully obtained from the formation 9 and moved into the storage tube 64.

One or more implementations of the sensor 240 may also be utilized in conjunction with other implementations of the coring tool 2 within the scope of the present disclosure. Such implementations may include one or more aspects depicted in and/or by one or more of FIGS. 1-15, one or more of the figures described below, and/or other aspects described herein or otherwise within the scope of the present disclosure.

Figure 17:
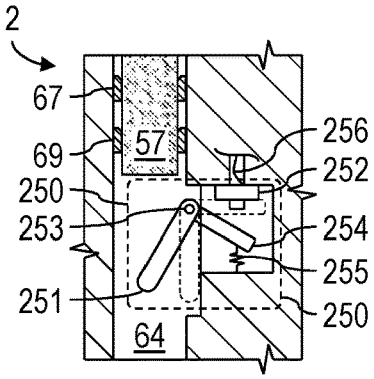

The coring tool 2 may also comprise a contact sensor operable to generate information about the presence of the core 57 within the storage tube 64 based on contact with the core 57 within the storage tube 64. For example, FIG. 17 is a schematic sectional view of a portion of another example implementation of the coring tool 2 shown in FIG. 11 according to one or more aspects of the present disclosure, wherein the coring tool 2 comprises a contact sensor 250 that includes a contact member 251 and an electrical switch 252. The contact member 251 is mechanically biased towards a deployed position in which the contact member 251 protrudes into the path of the core 57 within the storage tube 64, and is deflectable away from the deployed position by contact with the passing core 57. The electrical switch 252 opens and closes based on movement of the contact member 251, thus detecting the presence of the core 57 within the storage tube 64.

Figure 18:
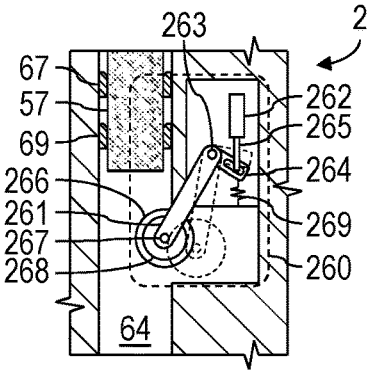

For example, as the core 57 is moved through the storage tube 64, it contacts the contact member 251. The contact member 251 thus rotates about a pivot 253. A switch member 254 is rigidly attached to the contact member 251 at the pivot 253, such that rotation of the contact member 251 in response to contact with the core 57 also rotates the switch member 254, until the switch member 254 contacts the switch 252, thus closing (or opening) the switch 252. The contact sensor 250 may also utilize a linear or rotary potentiometer (not shown in FIG. 17, but perhaps similar to as shown in FIG. 18) instead of the switch 252, such that the output of the potentiometer may be indicated of the present of the core 57 within the storage tube 64.

The rotated position of the contact member 251 and the switch member 254 are depicted in FIG. 17 in phantom lines. The contact member 251 may be mechanically biased to the deployed position (depicted in FIG. 17 by solid lines), such as by a spring and/or other biasing means 255.

The coring tool 2 may also comprise multiple instances of the contact sensor 250, such as may increase robustness of the core detection. One or more implementations of the contact sensor 250 may also be utilized in conjunction with other implementations of the coring tool 2 within the scope of the present disclosure. Such implementations may include one or more aspects depicted in and/or by one or more of FIGS. 1-16, one or more of the figures described below, and/or other aspects described herein or otherwise within the scope of the present disclosure.

Wires or other electrical conductors 256 leading away from the contact sensor 250 may provide electrical connection with a processing device (not shown in FIG. 17) located within the coring tool 2 that is operable to generate information related to the presence of the core 57 within the storage tube 64 based on information generated by the contact sensor 250. The processing device of the coring tool 2 may determine the presence of the core 57 within the storage tube 64, or the related information may be transmitted to surface equipment that may be operable for such determination. The information generated by the contact sensor 250 may also be utilized in combination with information generated by other sensors of the coring tool 2 for detecting the presence of the core 57 within the storage tube 64, measuring a length of the core 57, and/or determining other information about the core 57 in real-time, as described above.

FIG. 18 is a schematic sectional view of a portion of another example implementation of the coring tool 2 shown in FIG. 11 according to one or more aspects of the present disclosure, wherein the coring tool 2 comprises another implementation of a contact sensor 260. The contact sensor 260 comprises a contact member 261 and a linear potentiometer 262. The contact member 261 is mechanically biased towards a deployed position in which the contact member 261 protrudes into the storage tube 64 and is deflectable away from the deployed position by contact with the passing core 57. The linear potentiometer 262 is operable to measure deflection of the contact member 261 away from the deployed position in response to contact with the passing core 57.

For example, as the core 57 is moved through the storage tube 64, it contacts the contact member 261. The contact member 261 thus rotates about a pivot 263. An arm 264 is rigidly attached to the contact member 261 at the pivot 263, such that rotation of the contact member 261 in response to contact with the core 57 also rotates the arm 264. The arm 264 is operable connected to the piston 265 of the linear potentiometer 262, such as by a pin and slot arrangement, such that rotation of the arm 264 moves the piston 265 of the linear potentiometer 262 in an out. Such movement of the piston 265 of the linear potentiometer 262 changes the output signal of the linear potentiometer 262, which can thus be utilized to detect the presence of the core 57 within the storage tube 64.

A roller 266 may also be attached to the end of the contact member 261 that protrudes into the storage tube 64. The roller 266 may rotate about the end of the contact member 261, such as by means of a pivot connection 267 with the contact member 261. The core 57 may cause the roller 266 to rotate as the core 57 moves past the contact sensor 260 into the storage tube 64. The contact sensor 260 may also comprise a rotary potentiometer 268 operably coupled with the roller 266, such that rotation of the roller 266 in response to contact with the passing core 57 may also be utilized to detect the presence of the core 57 within the storage tube 64.

The rotated position of the contact member 261 and the arm 264 are depicted in FIG. 18 in phantom lines. The arm 264 may be mechanically biased to the deployed position (depicted in FIG. 18 by solid lines), such as by a spring and/or other biasing means 269.

The coring tool 2 may also comprise multiple instances of the contact sensor 260, such as may increase robustness of the core detection. One or more implementations of the contact sensor 260 may also be utilized in conjunction with other implementations of the coring tool 2 within the scope of the present disclosure. Such implementations may include one or more aspects depicted in and/or by one or more of FIGS. 1-17, one or more of the figures described below, and/or other aspects described herein or otherwise within the scope of the present disclosure.

Wires or other electrical conductors (not shown in FIG. 18) leading away from the contact sensor 260 may provide electrical connection with a processing device (not shown in FIG. 18) located within the coring tool 2 that is operable to generate information related to the presence of the core 57 within the storage tube 64 based on information generated by the contact sensor 260. The processing device of the coring tool 2 may determine the presence of the core 57 within the storage tube 64, or the related information may be transmitted to surface equipment that may be operable for such determination. The information generated by the contact sensor 260 may also be utilized in combination with information generated by other sensors of the coring tool 2 for detecting the presence of the core 57 within the storage tube 64, measuring a length of the core 57, and/or determining other information about the core 57 in real-time, as described above.

Figure 19:
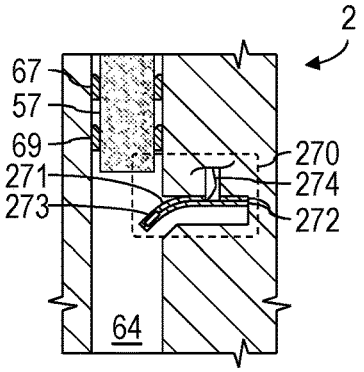

FIG. 19 is a schematic sectional view of a portion of another example implementation of the coring tool 2 shown in FIG. 11 according to one or more aspects of the present disclosure, wherein the coring tool 2 comprises another implementation of a contact sensor 270. The contact sensor 270 comprises a contact member 271 that is mechanically biased towards a deployed position in which the contact member 271 protrudes into the storage tube 64 and is deflectable away from the deployed position by contact with the passing core 57. The contact member 271 comprises at least two layers 272 of spring steel or other elastically deformable material, as well as a strain gauge or other sensor 273 operable to measure deflection of the contact member 271 away from the deployed position in response to contact with the passing core 57.

The coring tool 2 may also comprise multiple instances of the contact sensor 270, such as may increase robustness of the core detection. One or more implementations of the contact sensor 270 may also be utilized in conjunction with other implementations of the coring tool 2 within the scope of the present disclosure. Such implementations may include one or more aspects depicted in and/or by one or more of FIGS. 1-18, one or more of the figures described below, and/or other aspects described herein or otherwise within the scope of the present disclosure.

Wires or other electrical conductors 274 leading away from the strain gauge or other sensor 273 may provide electrical connection with a processing device (not shown in FIG. 19) located within the coring tool 2 that is operable to generate information related to the presence of the core 57 within the storage tube 64 based on information generated by the contact sensor 270. The processing device of the coring tool 2 may determine the presence of the core 57 within the storage tube 64, or the related information may be transmitted to surface equipment that may be operable for such determination. The information generated by the contact sensor 270 may also be utilized in combination with information generated by other sensors of the coring tool 2 for detecting the presence of the core 57 within the storage tube 64, measuring a length of the core 57, and/or determining other information about the core 57 in real-time, as described above.

Figure 20:
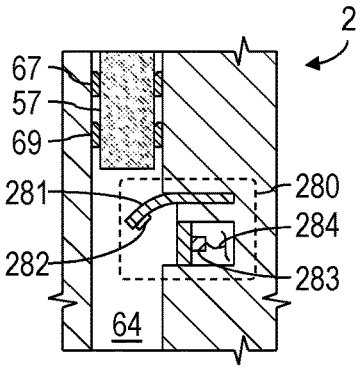

FIG. 20 is a schematic sectional view of a portion of another example implementation of the coring tool 2 shown in FIG. 11 according to one or more aspects of the present disclosure, wherein the coring tool 2 comprises another implementation of a contact sensor 280. The contact sensor 280 comprises a contact member 281 that is mechanically biased towards a deployed position in which the contact member 281 protrudes into the storage tube 64 and is deflectable away from the deployed position by contact with the passing core 57. The contact member 281 comprises one or more layers of spring steel or other elastically deformable material, as well as a permanent magnet 282 attached to (or near) the deflecting end of the contact member 282. The contact sensor 280 also comprises a Hall effect sensor 283 disposed substantially adjacent an outer perimeter of the storage tube 64 and operable to measure the magnetic field generated by the magnet 282. As the passing core 57 deflects the contact member 281, the magnet 282 gets closer to the sensor 283. The output signal of the sensor 283 is proportional to the magnet field it experiences, and thus provides a measurement of the deflection of the contact member 281, and thereby the presence of the core 57.

The coring tool 2 may also comprise multiple instances of the contact sensor 280, such as may increase robustness of the core detection. One or more implementations of the contact sensor 280 may also be utilized in conjunction with other implementations of the coring tool 2 within the scope of the present disclosure. Such implementations may include one or more aspects depicted in and/or by one or more of FIGS. 1-19, one or more of the figures described below, and/or other aspects described herein or otherwise within the scope of the present disclosure.

Wires or other electrical conductors 284 leading away from the sensor 283 may provide electrical connection with a processing device (not shown in FIG. 20) located within the coring tool 2 that is operable to generate information related to the presence of the core 57 within the storage tube 64 based on information generated by the contact sensor 280. The processing device of the coring tool 2 may determine the presence of the core 57 within the storage tube 64, or the related information may be transmitted to surface equipment that may be operable for such determination. The information generated by the contact sensor 280 may also be utilized in combination with information generated by other sensors of the coring tool 2 for detecting the presence of the core 57 within the storage tube 64, measuring a length of the core 57, and/or determining other information about the core 57 in real-time, as described above.

Figure 21:
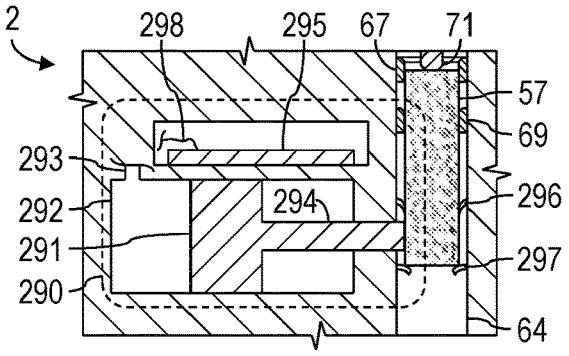

FIG. 21 is a schematic sectional view of a portion of another example implementation of the coring tool 2 shown in FIG. 11 according to one or more aspects of the present disclosure, wherein the coring tool 2 comprises another implementation of a contact sensor 290. The contact sensor 290 comprises a hydraulic gauging piston 291 that is selectively moved within a hydraulic cylinder 292 having an inlet 293 for fluidly communicating with a hydraulic fluid source (not shown) of the coring tool 2, perhaps in a manner similar to as described above with respect to FIG. 15. Various sealing means (not shown) may also exist, perhaps also similar to the manner described above with respect to FIG. 15.

A contact member 294 coupled to or otherwise carried with the piston 291 is selectively extendable into the storage tube 64 to contact the core 57. The contact sensor 290 also comprises a switch, potentiometer, or other sensor 295 operable to determine a distance to which the contact member 294 has extended into the storage tube 64. The core 57 may be held stationary and/or substantially centralized within the storage tube 64 by core retainer tabs extending radially inward within an upper portion of the storage tube 64. For example, an upper set of core retainer tabs 296 may be located slightly above the end of the contact member 294, and a lower set of core retainer tabs 297 may be located slightly below the end of the contact member 294. The core retainer tabs 296 and 297 may each comprise one or more layers of spring steel or other elastically deformable material.

The piston 291 may be selectively moved within the cylinder 292 via hydraulic pressure to extend the contact member 294 into contact with the core 57. The pressure of the hydraulic fluid within the cylinder 292 may then be utilized with the position information generated by the sensor 295 to determine the presence of the core 57 within the storage tube 64. The pressure and position information may also be utilized to measure the diameter of the core 57.

The coring tool 2 may also comprise multiple instances of the contact sensor 290, such as may increase robustness of the core detection. One or more implementations of the contact sensor 290 may also be utilized in conjunction with other implementations of the coring tool 2 within the scope of the present disclosure. Such implementations may include one or more aspects depicted in and/or by one or more of FIGS. 1-20, one or more of the figures described below, and/or other aspects described herein or otherwise within the scope of the present disclosure.

Wires or other electrical conductors 298 leading away from the sensor 295 may provide electrical connection with a processing device (not shown in FIG. 21) located within the coring tool 2 that is operable to generate information related to the presence of the core 57 within the storage tube 64 based on information generated by the contact sensor 290. The processing device of the coring tool 2 may determine the presence of the core 57 within the storage tube 64, or the related information may be transmitted to surface equipment that may be operable for such determination. The information generated by the contact sensor 290 may also be utilized in combination with information generated by other sensors of the coring tool 2 for detecting the presence of the core 57 within the storage tube 64, measuring a length of the core 57, and/or determining other information about the core 57 in real-time, as described above.

While aspects of the present disclosure may be described above in the context of wireline tools, one or more of such aspects may also be applicable to other downhole tools, such as drillstring tools and/or coiled tubing tools. During drilling operations, for example, after a formation of interest is reached, drillers may investigate the formation and/or its contents through the use of downhole formation evaluation tools. Some example formation evaluation tools may be part of the drillstring used to form the wellbore, and may thus be utilized to evaluate formations during the drilling process instead of tripping the drillstring out of the wellbore and then conveying a wireline tool within the wellbore to the formation of interest. Such tools may comprise measurement-while-drilling (MWD) tools, such as may be operable for measuring the drill bit trajectory as well as wellbore temperature and pressure. Such tools may also or instead comprise logging-while-drilling (LWD) tools operable for measuring formation and/or formation fluid parameters or properties, such as resistivity, porosity, permeability, viscosity, density, phase-change pressure, and sonic velocity, among others. Real-time data, such as the formation pressure, may permit making decisions about drilling mud weight and composition, as well as decisions about drilling rate and WOB during the drilling process. While LWD and MWD have different meanings to those of ordinary skill in the art, that distinction is not germane to this disclosure, and therefore this disclosure does not distinguish between the two terms. It is also noted that LWD and MWD may not be performed while the drill bit is actually rotating to extend the wellbore. For example, the drill bit may be briefly stopped so that LWD and MWD may occur during interruptions in the drilling process, after which drilling may resume. Such LWD and MWD measurements taken during intermittent breaks in drilling are still considered to be "while-drilling" because they do not entail removing the drillstring from the wellbore.

Figure 22:
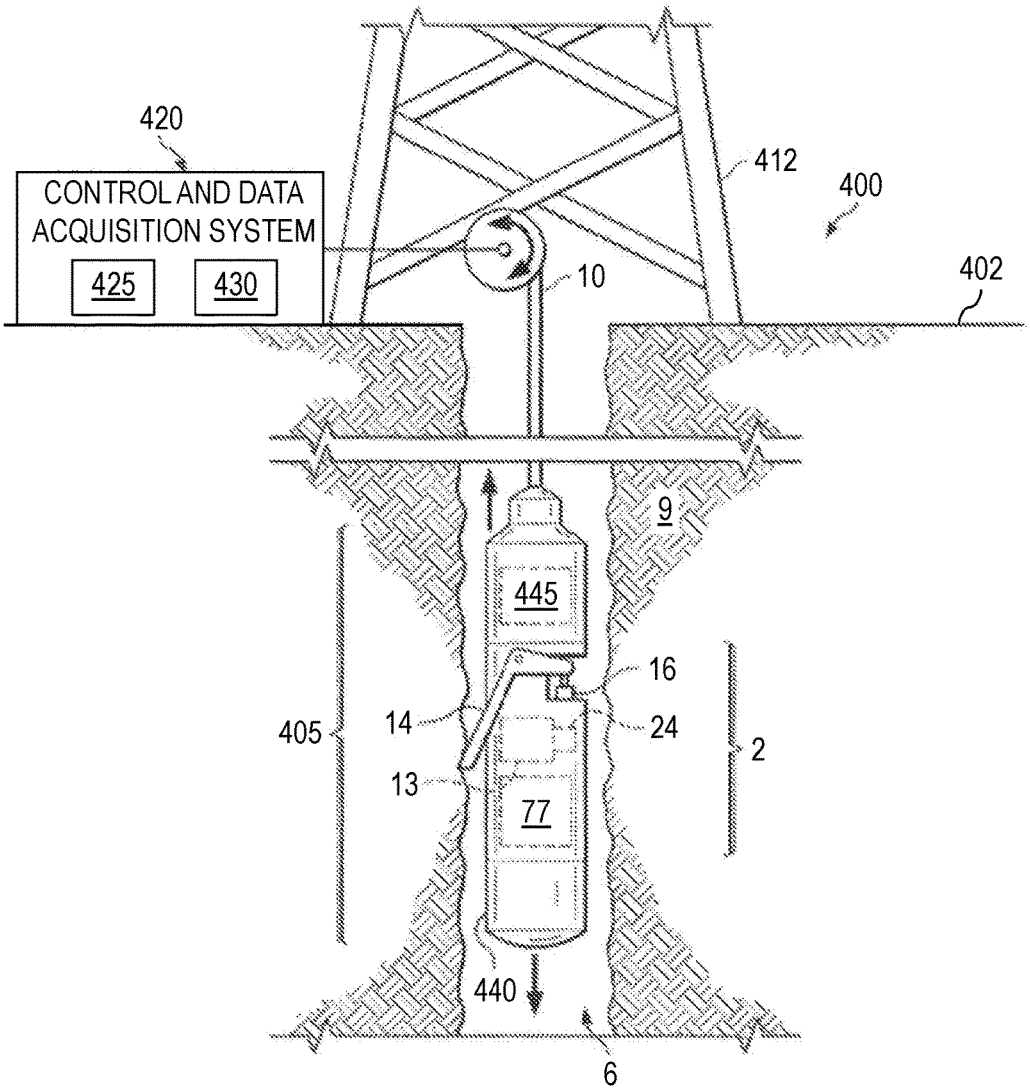
FIGS. 22 and 23 are schematic views of example implementations of wellsite systems according to aspects of the present disclosure.

Other example formation evaluation tools may be used after the wellbore has been drilled or formed and the drillstring has been removed from the wellbore. Such tools may be lowered into a wellbore using a wireline 10 for electronic communication and/or power transmission, and therefore are commonly referred to as wireline tools. FIG. 22 is a schematic view of at least a portion of an example implementation of a wireline system 400 comprising the coring tool 2 according to one or more aspects of the present disclosure. The wireline system 400 of FIG. 22 may be situated onshore (as shown) and/or offshore. The wireline system 400 comprises a wireline toolstring 405 comprising one or more tools or modules connected end to end.

The wireline toolstring 405 of FIG. 22 may be suspended from a rig 412 into the wellbore 6. The wireline toolstring 405 maybe suspended in the wellbore 6 at the lower end of a multi-conductor cable and/or other wireline 10, which may be spooled on a winch (not shown) at the wellsite surface 402. At the wellsite surface 402, the wireline 10 may be communicatively and/or electrically coupled to a control and data acquisition system 420. The control and data acquisition system 420 may comprise an interface 425 operable to receive commands from a surface operator (e.g., a human operator). The control and data acquisition system 420 may also comprise a processing device 430 operable for controlling the extraction and/or storage of core samples by the wireline toolstring 405.

The wireline toolstring 405 may also comprise a telemetry module 445, which may be communicably and/or otherwise coupled with the coring tool 2. However, while the telemetry module 445 is depicted in FIG. 22 as being implemented separate from the coring tool 2, the telemetry module 445 may instead be implemented integral to or otherwise within the coring tool 2. The telemetry module 445 may comprise a downhole control system (not shown) communicatively coupled to the control and data acquisition system 420. In such implementations, the control and data acquisition system 420 and/or the downhole control system may control operation of the coring tool 2.

Additional and/or alternative components, modules, and/or tools may also be implemented within the wireline toolstring 405, as generally indicated in FIG. 22 by reference number 440. In such implementations, the components, modules, and/or tools 2, 440, and/or 445 may be operatively connected together by various types of field joints, box-pin connections, and/or other connection means.

Figure 23:
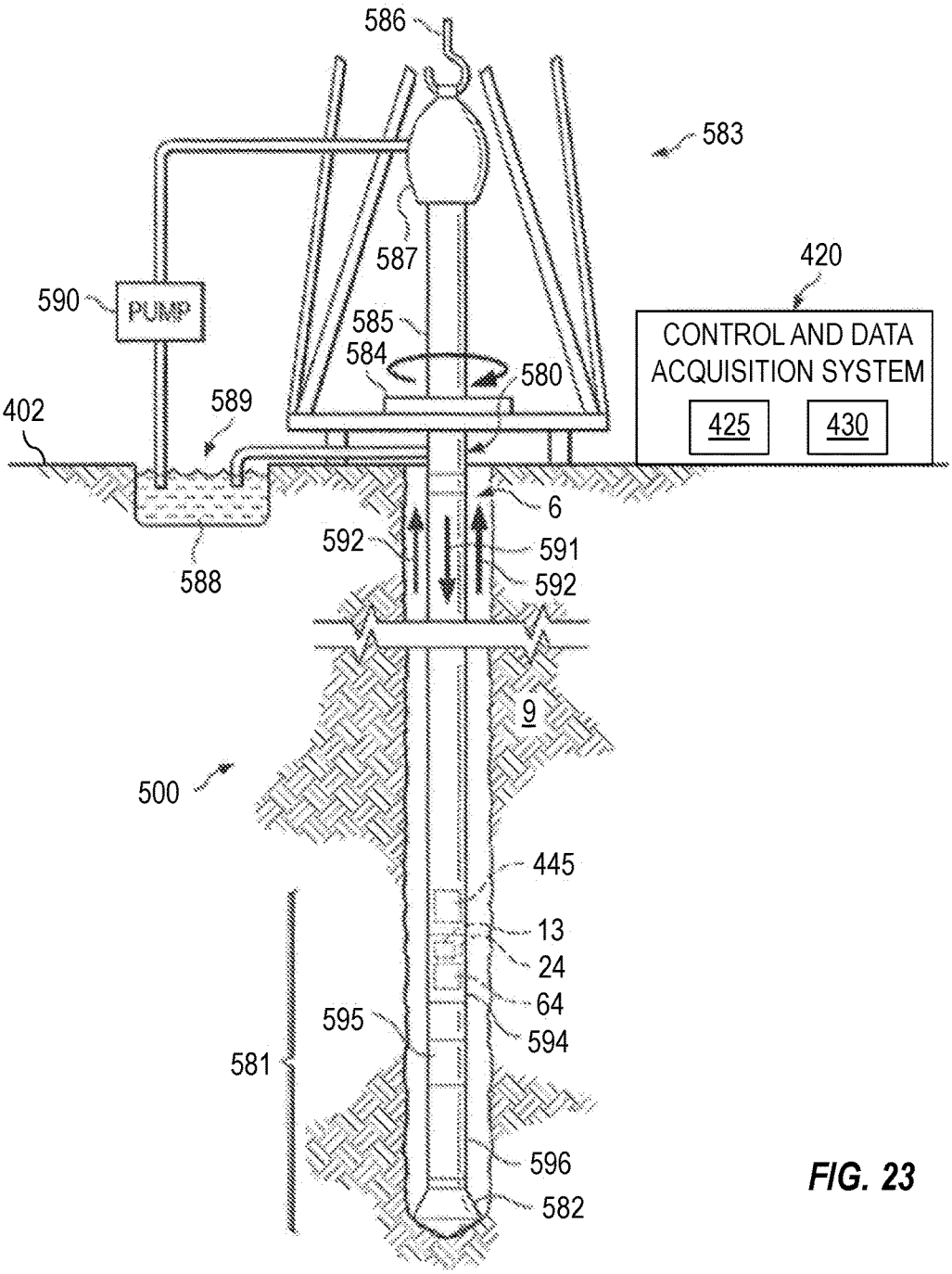

FIG. 23 is a schematic view of at least a portion of an example implementation of a wellsite drilling system 500 according to one or more aspects of the present disclosure, which may be employed onshore (as shown) and/or offshore, including at the same wellsite surface 402 depicted in FIG. 22. The wellsite system 500 may be utilized to form the wellbore 6 in the subsurface formation 9 by rotary and/or directional drilling. A drillstring 580 suspended within the wellbore 6 comprises a bottom-hole-assembly (BHA) 581 and a drill bit 582 at its lower end. The drill bit 582 may also form a portion of the BHA 581. At the wellsite surface 402, a surface system includes a platform and derrick assembly 583 positioned over the wellbore 6. The assembly 583 may comprise a rotary table 584, a kelly 585, a hook 586, and a rotary swivel 587. The rotary table 584, energized by means not shown, engages the kelly 585, which is attached to the upper end of the drillstring 580, so as to rotate the drillstring 580. The rotary swivel 587 is suspended from the hook 586 (which may be attached to a traveling block, not shown), the kelly 585 is suspended from the rotary swivel 587, and the drillstring 580 may be suspended from the kelly 585, thus permitting rotation of the drillstring 580 relative to the hook 586. A top drive system may be utilized to rotate the drillstring 580 instead of, or in addition to, the rotary table 584 and kelly 585.

The wellsite system 500 may also include drilling fluid 588, which is commonly referred to in the industry as mud, stored in a pit or other container 589 at the wellsite. A pump 590 may deliver the drilling fluid 588 to the interior of the drillstring 580 via a port (not shown) in the swivel 587, causing the drilling fluid 588 to flow downwardly through the drillstring 580, as indicated in FIG. 23 by directional arrow 591. The drilling fluid 588 may exit the drillstring 580 via water courses, nozzles, jets, and/or ports in the drill bit 582, and then circulate upwardly through the annulus region between the outside of the drillstring 580 and the sidewall of the wellbore 6, as indicated in FIG. 23 by directional arrows 592. The drilling fluid 588 may be used to lubricate the drill bit 582 and/or carry formation cuttings up to the surface, where the drilling fluid 588 may be cleaned and returned to the container 589 for recirculation. It should be noted that in some implementations the drill bit 582 may be omitted, and the BHA 581 may be conveyed within the wellbore 6 via coiled tubing and/or pipe.

The BHA 581 may comprise various numbers and/or types of while-drilling modules and/or tools, such as LWD and/or MWD modules. In the example implementation depicted in FIG. 23, the BHA 581 comprises an LWD module 594 and an MWD module 595, although additional LWD and/or MWD modules 594, 595 may also exist. The depicted BHA also comprises a rotary-steerable system or mud motor 596 and/or the drill bit 582.

The LWD module 594 may be housed in a special type of drill collar, as it is known in the art, and may contain various numbers and/or types of logging tools, measurement tools, sensors, devices, formation evaluation tools, fluid analysis tools, and/or fluid sampling devices, among other examples. The example LWD module 594 depicted in FIG. 23 may implement the coring tool 2 described above. Thus, the LWD module 594 may comprise, among other components described above with respect to the coring tool 2, the core drilling mechanism 13, the coring bit 24, and the storage tube 64, as schematically depicted in FIG. 23. The same or different LWD modules may implement capabilities for measuring, processing, and/or storing information, as well as the example telemetry module 445 shown in FIG. 22, such as for communicating with the MWD module 595 and/or directly with the control and data acquisition system 420 and/or other surface equipment.

The MWD module 595 may also be housed in a special type of drill collar, and may contain one or more devices for measuring characteristics of the drillstring 580, the drill bit 582, and/or the wellbore 6. The measuring devices may be utilized for measuring WOB, torque, vibration, shock, stick/slip, direction, and/or inclination, among other examples. The MWD module 595 may also include capabilities for measuring, processing, and storing information, as well as for communicating with the control and data acquisition system 420 and/or other surface equipment. For example, the MWD module 595 and the control and data acquisition system 420 may communicate information uphole and/or downhole, such as via mud-pulse telemetry, wired drillpipe telemetry, electromagnetic telemetry, and/or acoustic telemetry, among other examples. The MWD tool 595 may also comprise a battery system and/or apparatus (neither shown) for generating electrical power for use by the BHA 581, such as a mud turbine generator powered by the flow of the drilling fluid 588 within the drillstring 580.

Figure 24:
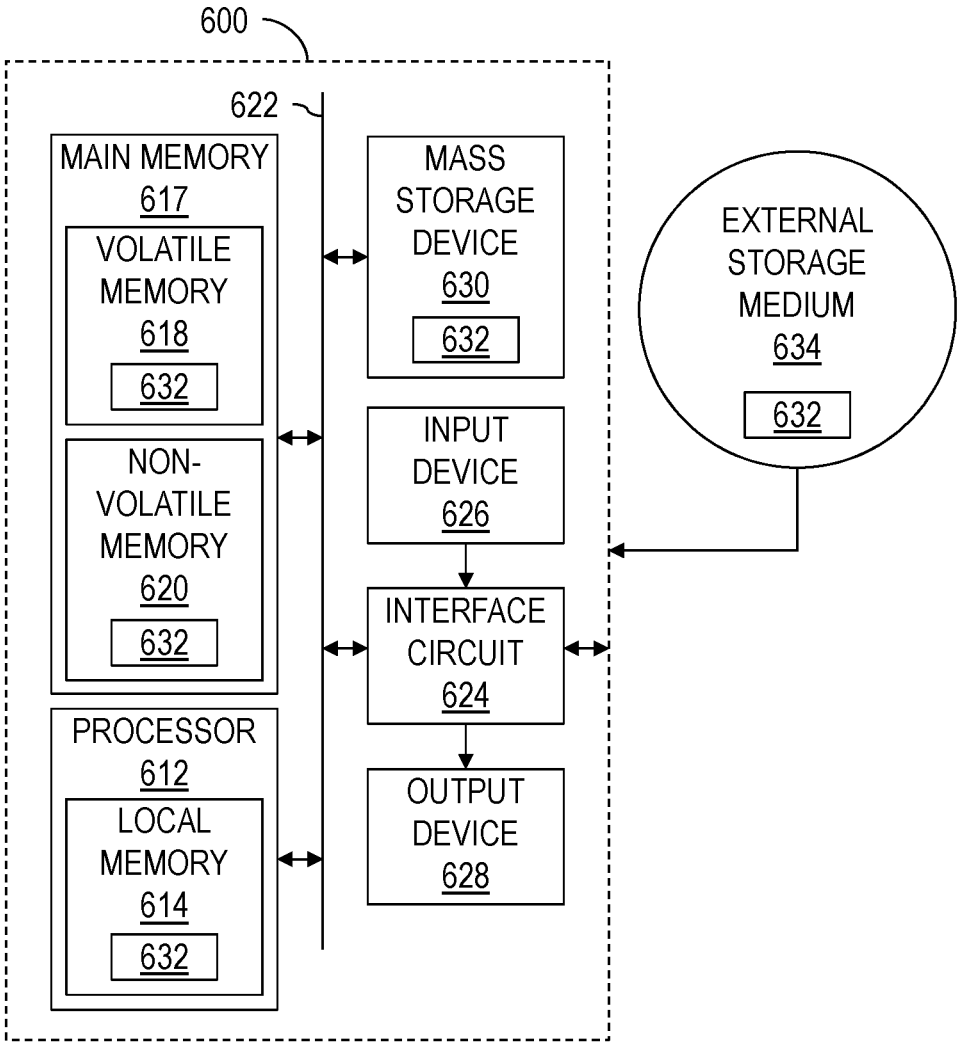
FIG. 24 is a schematic view of at least a portion of an example implementation of apparatus according to one or more aspects of the present disclosure.

FIG. 24 is a schematic view of at least a portion of an example implementation of a processing device 600 according to one or more aspects of the present disclosure. Implementations of the coring tool 2 described above may include one or more instances processing device 600, or perhaps similar processing devices comprising various subsets of the components described below. The control and data acquisition system 420 and/or the processing device 430 depicted in FIGS. 22 and 23 and/or other controllers and processing devices described above may also be implemented as one or more instances of the processing device 600, or perhaps similar processing devices comprising various subsets of the components described below. Thus, one or more instances of the processing device 600 may perform or be utilized in the control of coring operations conducted with the coring tool 2, including for determining the presence of the core 57 within the storage tube 64 of the coring tool 2 and/or other characteristics of the core 57, the various core retaining devices described above, and/or other components of the coring tool 2. In such implementations, the one or more instances of the processing device 600, or at least components thereof, may form part of the coring tool 2, the surface equipment (such as the control and data acquisition system 420), or both.

The processing device 600 may be or comprise one or more general- or special-processors, computing devices, servers, personal computers, personal digital assistant (PDA) devices, smartphones, internet appliances, and/or other types of computing devices. The processing device 600 may comprise a processor 612, such as a general-purpose programmable processor. The processor 612 may comprise a local memory 614, and may execute coded instructions 632 present in the local memory 614 and/or another memory device. The coded instructions 632 may include machine-readable instructions or programs to implement the methods and/or processes described herein. For example, the coded instructions 632 may include program instructions or computer program code that, when executed by the processor 612, facilitate determining the presence of a core 57 within the storage tube 64 and/or other characteristics of the core 57, and/or performing other methods and/or processes described herein. The processor 612 may be, comprise, or be implemented by one or more processors of various types suitable to the local application environment, and may include one or more general- or special-purpose computers, microprocessors, digital signal processors (DSPs), field-programmable gate arrays (FPGAs), application-specific integrated circuits (ASICs), and processors based on a multi-core processor architecture, among other examples.

The processor 612 may be in communication with a main memory 617, such as via a bus 622 and/or other communication means. The main memory 617, or at least a portion thereof, is an example implementation of the memory described above with respect to one or more of FIGS. 1-21. The main memory 617 may comprise a volatile memory 618 and/or a non-volatile memory 620. The volatile memory 618 may be, comprise, or be implemented by random access memory (RAM), static random access memory (SRAM), synchronous dynamic random access memory (SDRAM), dynamic random access memory (DRAM), RAMBUS dynamic random access memory (RDRAM), and/or other types of random access memory devices. The non-volatile memory 620 may be, comprise, or be implemented by read-only memory, flash memory, and/or other types of memory devices. One or more memory controllers (not shown) may control access to the volatile memory 618 and/or non-volatile memory 620. The processing device 600 may be operable to store or record (e.g., on the main memory 617) the signals or information generated by and/or received from the sensors described above with respect to FIGS. 11-21. The processing device 600 may be further operable to perform the analyses and data generation described above with respect to FIGS. 12-14.

The processing device 600 may also comprise an interface circuit 624 to facilitate communications with other processing devices and/or the above-described sensors. The interface circuit 624 may be, comprise, or be implemented by various types of standard interfaces, such as an Ethernet interface, a universal serial bus (USB) interface, and/or a third generation input/output (3GIO) interface, among other examples. The interface circuit 624 may also comprise a graphics driver card. The interface circuit 624 may also comprise a communication device, such as a modem or network interface card, to facilitate exchange of data with external computing devices via a network (e.g., Ethernet connection, digital subscriber line (DSL), telephone line, coaxial cable, cellular telephone system, satellite, etc.).

One or more input devices 626 may also be connected to the interface circuit 624. The input devices 626 may permit a human operator to enter data and/or commands for operation of the processor 612 and/or other components of the processing device 600. The input devices 626 may be, comprise, or be implemented by a keyboard, a mouse, a touchscreen, a track-pad, a trackball, an isopoint, and/or a voice recognition system, among other examples.

One or more output devices 628 may also be connected to the interface circuit 624. The output devices 628 may be, comprise, or be implemented by display devices (e.g., a liquid crystal display (LCD) or cathode ray tube display (CRT), among others), printers, and/or speakers, among other examples.

The processing device 600 may also comprise one or more mass storage devices 630 for storing machine-readable instructions and data. Examples of such mass storage devices 630 include hard disk drives, compact disk (CD) drives, and digital versatile disk (DVD) drives, among other examples. The coded instructions 632 may be stored in the mass storage device 630, the volatile memory 618, the non-volatile memory 620, the local memory 614, and/or on a removable storage medium 634, such as a CD or DVD. Thus, the processing device 600 may be implemented in accordance with hardware (embodied in one or more chips including an integrated circuit, such as an ASIC), or may be implemented as software or firmware for execution by one or more processors, such as the processor 612. In the case of firmware or software, the embodiment may be provided as a computer program product including a computer-readable medium or storage structure embodying computer program code (i.e., software or firmware) thereon for execution by the processor 612.

The coded instructions 632 may include program instructions or computer program code that, when executed by the processor 612, cause the processing device 600 to perform methods and processes as described herein. For example, the coded instructions 632, when executed, may cause the processing device 600 to receive, process, and/or record the signals or information generated by and/or received from the above-described sensors for determining the presence and/or other characteristics of a core 57 within the storage tube 64 of the coring tool 2.

In view of the entirety of the present disclosure, including the claims and the figures, a person having ordinary skill in the art will readily recognize that the present disclosure introduces an apparatus comprising a coring tool. The coring tool comprises a coring bit operable to obtain a core sample of a subterranean formation from a sidewall of a wellbore extending into the subterranean formation. The coring tool also comprises: a storage tube; an actuator operable to move the core from the coring bit into the storage tube; and a sensor operable to generate information related to presence of the core within the storage tube.

The sensor may be disposed substantially adjacent an outer perimeter of the storage tube, proximate an end of the storage tube through which the actuator moves the core. The sensor may be or comprise an ultrasonic sensor and/or a resistivity sensor. The sensor may also or instead be or comprise a sonic sensor comprising a transmitter and a receiver, and the storage tube may interpose the transmitter and the receiver. The sensor may also or instead be or comprise a gamma ray sensor comprising a source and a detector, and the storage tube may interpose the source and the detector.

The sensor may also or instead be or comprise a contact sensor operable to generate the information based on contact with the core within the storage tube. The contact sensor may comprise: a contact member, mechanically biased towards a position in which the contact member protrudes into the storage tube, and deflectable away from the position by contact with the core; and an electrical switch that opens and closes based on movement of the contact member. The contact sensor may also or instead comprise: a contact member, mechanically biased towards a position in which the contact member protrudes into the storage tube, and deflectable away from the position by contact with the core; and a linear potentiometer operable to measure deflection of the contact member away from the position. The contact sensor may also or instead comprise: a roller rotated by the core as the core moves into the storage tube; and a rotary potentiometer operable to measure rotation of the roller. The contact sensor may also or instead comprise: a contact member, mechanically biased towards a position in which the contact member protrudes into the storage tube, and deflectable away from the position by contact with the core; and a strain gauge attached to the contact member and operable to detect strain in the contact member resulting from deflection of the contact member in response to contact with the core. The contact sensor may also or instead comprise: a contact member, mechanically biased towards a position in which the contact member protrudes into the storage tube, and deflectable away from the position by contact with the core; a magnet attached to a deflectable end of the contact member, wherein the magnet produces a magnetic field; and a Hall-effect sensor disposed substantially adjacent an outer perimeter of the storage tube and operable to measure the magnetic field. The contact sensor may also or instead comprise: a member disposed external to the storage tube and selectively extendable into the storage tube to contact the core; and a switch or potentiometer operable to determine a distance to which the member has extended into the storage tube.

The actuator may be operable to move the core from the coring bit into the storage tube by applying a force on the core throughout a distance extending between a first core position and a second core position. When the core is in the first core position, the core may be retained within the coring bit, and when the core is in the second core position, the core may be contained within the storage tube. The sensor may be a first sensor operable to generate information related to the force, and the coring tool may further comprise a second sensor operable to generate information related to location of the core between the first and second core positions. The second sensor may comprise a potentiometer.

The apparatus may further comprise a processor and a memory storing instructions that, when executed, cause the processor to determine the presence of the core within the storage tube based on the force information generated by the first sensor and the location information generated by the second sensor. When executed, the instructions may further cause the processor to generate information indicative of the length of the core based on the force information generated by the first sensor and the location information generated by the second sensor. When the core is in the first core position, the core may be retained by a core retainer disposed within the coring bit, and the instructions, when executed, may further cause the processor to generate information indicative of remaining functional life of the core retainer based on the force information generated by the first sensor and the location information generated by the second sensor. When executed, the instructions may further cause the processor to generate a force-versus-location profile utilizing the force information generated by the first sensor and the location information generated by the second sensor. The force-versus-location profile may be indicative of the presence of the core within the storage tube. When executed, the instructions may further cause the processor to determine the presence of the core within the storage tube by comparison of the force-versus-location profile to a predetermined force-versus-location profile stored in the memory.

The coring tool may comprise the processor and the memory. The coring tool may be in communication with surface equipment disposed at a wellsite from which the wellbore extends, and the surface equipment may comprise the processor and the memory. The coring tool and the surface equipment may collectively comprise the processor (or processors) and the memory (or memories).

The first sensor may comprise a load cell connected to the actuator. The actuator may comprise a piston operated by hydraulic fluid to apply the force on the core, and the first sensor may also or instead comprise a pressure sensor operable to sense pressure of the hydraulic fluid as the piston moves the core from the coring bit into the storage tube.

The coring tool may further comprise a core blocker selectively movable into the storage tube to temporarily prevent the core from moving past the second core position.

The present disclosure also introduces a method comprising conveying a coring tool within a wellbore extending into a subterranean formation, wherein the coring tool comprises a coring bit, a storage tube, an actuator, and a sensor. The method also includes operating the coring tool to obtain, with the coring bit, a sample core of the subterranean formation from a sidewall of the wellbore. The method also includes operating the actuator to move the core from the coring bit to the storage tube while generating information with the sensor. The method also includes, via operation of a processing device, determining the presence of the core within the storage tube based on the information generated by the sensor.

The method may further comprise, while determining the presence of the core within the storage tube, selectively moving a core blocker of the coring tool into the storage tube to temporarily prevent the core from moving past the second core position.

The method may further comprise, while determining the presence of the core within the storage tube, selectively moving a contact member into contact with the core within the storage tube to determine a diameter of the core.

The method may further comprise, while determining the presence of the core within the storage tube, selectively moving a contact member into contact with the core within the storage tube to determine the length of the core.

Operating the actuator may comprise applying a force on the core throughout a distance extending between a first core position and a second core position. When the core is in the first core position, the core may be retained within the coring bit, and when the core is in the second core position, the core may be contained within the storage tube. The sensor may be a first sensor operable to generate information related to the force, and the coring tool may further comprise a second sensor operable to generate information related to location of the core between the first and second core positions. Determining the presence of the core within the storage tube may be based on the force information generated by the first sensor and the location information generated by the second sensor. The method may further comprise, via operation of the processing device, generating information indicative of length of the core based on the force information generated by the first sensor and the location information generated by the second sensor.

When the core is in the first core position, a core retainer disposed within the coring bit may retain the core. In such implementations, among others within the scope of the present disclosure, the method may further comprise, via operation of the processing device, generating information indicative of remaining functional life of the core retainer based on the force information generated by the first sensor and the location information generated by the second sensor.

The method may further comprise, via operation of the processing device, generating a force-versus-location profile utilizing the force information generated by the first sensor and the location information generated by the second sensor, and determining the presence of the core within the storage tube may be based on the force-versus-location profile. The method may further comprise, via operation of the processing device, comparing the force-versus-location profile to a predetermined force-versus-location profile to determine the presence of the core within the storage tube.

The coring tool may comprise the processing device. The coring tool may be in communication with surface equipment disposed at a wellsite from which the wellbore extends, the surface equipment may comprise the processing device, and the method may further comprise transmitting the force information generated by the first sensor and the location information generated by the second sensor to the surface equipment.

The present disclosure also introduces a method comprising conveying a coring tool within a wellbore extending into a subterranean formation, wherein the coring tool comprises a coring bit, a storage tube, an actuator, a force sensor, and a location sensor. The method also comprises operating the coring tool to obtain, with the coring bit, a sample core of the subterranean formation from a sidewall of the wellbore. The method also comprises operating the actuator to move the core from the coring bit to the storage tube while the force sensor generates force information related to a force applied to the core by the actuator, and while the location sensor generates location information related to a location of the core relative to the storage tube. The method also comprises, via operation of a processing device, generating a force-versus-location profile utilizing the force information and the location information, and determining the presence of the core within the storage tube based on the force-versus-location profile.

Determining the presence of the core within the storage tube may comprise comparing the force-versus-location profile to a predetermined force-versus-location profile stored in memory associated with the processing device.

The method may further comprise, via operation of the processing device, generating information indicative of length of the core based on the force-versus-location profile.

The method may further comprise, via operation of the processing device, generating information indicative of remaining functional life of a core retainer based on the force-versus-location profile. The coring bit may comprise the core retainer, or the core retainer may be located within the storage tube.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to permit the reader to quickly ascertain the nature of the technical disclosure. It is submitted with the understanding that it will not be used to interpret or limit the scope or meaning of the claims.

What is claimed is:

1. An apparatus, comprising:

a coring tool, comprising:

a coring bit operable to obtain a core sample of a subterranean formation from a sidewall of a wellbore extending into the subterranean formation;

a storage tube;

an actuator operable to move the core from the coring bit into the storage tube; and a sensor operable to generate information related to presence of the core within the storage tube;

wherein the sensor is disposed substantially adjacent an outer perimeter of the storage tube, proximate an end of the storage tube through which the actuator moves the core, and wherein the sensor is at least one of:

an ultrasonic sensor;

a resistivity sensor;

a sonic sensor comprising a transmitter and a receiver, wherein the storage tube interposes the transmitter and the receiver; and a gamma ray sensor comprising a source and a detector, wherein the storage tube interposes the source and the detector.

2. The apparatus of claim 1 wherein:

the actuator is operable to move the core from the coring bit into the storage tube by applying a force on the core throughout a distance extending between a first core position and a second core position;

when the core is in the first core position, the core is retained within the coring bit; and when the core is in the second core position, the core is contained within the storage tube; and the coring tool further comprises a first sensor operable to generate information related to the force; and a second sensor operable to generate information related to location of the core between the first and second core positions.

3. The apparatus of claim 2 wherein the apparatus further comprises a processor and a memory storing instructions that, when executed, cause the processor to determine the presence of the core within the storage tube based on the force information generated by the first sensor and the location information generated by the second sensor.

4. The apparatus of claim 3 wherein the instructions, when executed, further cause the processor to generate a force-versus-location profile utilizing the force information generated by the first sensor and the location information generated by the second sensor, and wherein the force-versus-location profile is indicative of the presence of the core within the storage tube.

5. The apparatus of claim 2 wherein the coring tool further comprises a core blocker selectively movable into the storage tube to temporarily prevent the core from moving past the second core position.

6. A method, comprising:

conveying a coring tool within a wellbore extending into a subterranean formation, wherein the coring tool comprises:

a coring bit;

a storage tube;

an actuator; and a sensor;

operating the coring tool to obtain, with the coring bit, a sample core of the subterranean formation from a sidewall of the wellbore;

operating the actuator by applying a force on the core throughout a distance extending between a first core position and a second core position to move the core from the coring bit to the storage tube while generating information with the sensor, wherein the sensor is a first sensor operable to generate information related to the force and the coring tool further comprises a second sensor operable to generate information related to location of the core between the first and second core positions; and via operation of a processing device, determining the presence of the core within the storage tube based on the force information generated by the first sensor and the location information generated by the second sensor.

7. The method of claim 6 wherein:

when the core is in the first core position, the core is retained within the coring bit; and when the core is in the second core position, the core is contained within the storage tube.

8. The method of claim 7 further comprising, via operation of the processing device, generating information indicative of length of the core based on the force information generated by the first sensor and the location information generated by the second sensor.

9. The method of claim 7 wherein:

when the core is in the first core position, the core is retained by a core retainer disposed within the coring bit; and the method further comprises, via operation of the processing device, generating information indicative of remaining functional life of the core retainer based on the force information generated by the first sensor and the location information generated by the second sensor.

10. The method of claim 7 further comprising, via operation of the processing device, generating a force-versus-location profile utilizing the force information generated by the first sensor and the location information generated by the second sensor, and wherein determining the presence of the core within the storage tube is based on the force-versus-location profile.

11. The method of claim 7 further comprising, while determining the presence of the core within the storage tube, selectively moving a core blocker of the coring tool into the storage tube to temporarily prevent the core from moving past the second core position.

12. The method of claim 7 further comprising, while determining the presence of the core within the storage tube, selectively moving a contact member into contact with the core within the storage tube to determine a diameter or length of the core.

13. A method, comprising:

conveying a coring tool within a wellbore extending into a subterranean formation, wherein the coring tool comprises a coring bit, a storage tube, an actuator, a force sensor, and a location sensor;

operating the coring tool to obtain, with the coring bit, a sample core of the subterranean formation from a sidewall of the wellbore;

operating the actuator to move the core from the coring bit to the storage tube while:

the force sensor generates force information related to a force applied to the core by the actuator; and the location sensor generates location information related to a location of the core relative to the storage tube; and via operation of a processing device:

generating a force-versus-location profile utilizing the force information and the location information; and determining the presence of the core within the storage tube based on the force-versus-location profile.

14. The method of claim 13 wherein determining the presence of the core within the storage tube comprises comparing the force-versus-location profile to a predetermined force-versus-location profile stored in memory associated with the processing device.

15. The method of claim 13 further comprising, via operation of the processing device, generating information indicative of length of the core based on the force-versus-location profile.

16. The method of claim 13 further comprising, via operation of the processing device, generating information indicative of remaining functional life of a core retainer based on the force-versus-location profile, wherein the core retainer is disposed within the coring bit or the storage tube.

* * * * *